US008256855B2

(12) United States Patent
Yamada

(10) Patent No.: US 8,256,855 B2
(45) Date of Patent: Sep. 4, 2012

(54) METHOD FOR CONFIRMING INK CIRCULATION PATH AND METHOD FOR FILLING WITH INK

(75) Inventor: Takahisa Yamada, Hachioji (JP)

(73) Assignee: Riso Kagaku Corporation, Tokyo (JP)

( * ) Notice: Subject to any disclaimer, the term of this patent is extended or adjusted under 35 U.S.C. 154(b) by 862 days.

(21) Appl. No.: 12/348,469

(22) Filed: Jan. 5, 2009

(65) Prior Publication Data

US 2009/0174735 A1 Jul. 9, 2009

(30) Foreign Application Priority Data

Jan. 4, 2008 (JP) ..... 2008-000167

(51) Int. Cl.
*B41J 2/195* (2006.01)
*B41J 2/19* (2006.01)

(52) U.S. Cl. ..... 347/7; 347/92

(58) Field of Classification Search ..... 347/6, 7, 347/85, 89, 92
See application file for complete search history.

(56) References Cited

U.S. PATENT DOCUMENTS 6,350,021 B1 * 2/2002 Gray et al. ..... 347/78

FOREIGN PATENT DOCUMENTS

JP 2006-150745 A 6/2006
JP 2007-7944 A 1/2007

* cited by examiner

*Primary Examiner* — Geoffrey Mruk
(74) *Attorney, Agent, or Firm* — Holtz, Holtz, Goodman & Chick, PC

(57) ABSTRACT

An image forming apparatus which ejects ink to form an image on a recording medium flows the ink from an upstream side tank to a downstream side tank on an ink circulation path, includes a sensor for detecting a parameter corresponding to variations in amount of the ink in the downstream side tank, and confirms ink circulation in accordance with an amount of ink which returns through circulation from an appropriate amount of ink and a measured time.

17 Claims, 20 Drawing Sheets

METHOD FOR CONFIRMING INK CIRCULATION PATH AND METHOD FOR FILLING WITH INK

CROSS-REFERENCE TO RELATED APPLICATIONS

This application is based upon and claims the benefit of priority from prior Japanese Patent Application No. 2008-000167, filed Jan. 4, 2008, the entire contents of which are incorporated herein by reference.

BACKGROUND OF THE INVENTION

1. Field of the Invention

The present invention relates to a method for confirming ink circulation path and a method for filling with ink in an inkjet image forming apparatus in which a circulation mechanism is disposed on an ink supply flow path.

2. Description of the Related Art

In general, an inkjet image forming apparatus which forms an image by ejecting ink to a recording medium has been well known. This image forming apparatus may comprises an ink return flow path for returning the ink which has not been used for image formation as well as an ink supply flow path for supplying the ink to a recording head; and an ink circulation path for circulating the ink between an ink supply means and the recording head.

Circulating the ink in such a manner prevents the recording head in drive from increasing its temperature by utilizing a radiation effect caused by moving ink, and achieves removal of bubbles generated in the recording head and prevention of the ink from increasing its viscosity.

For instance, a technique related to initial filling to a circulation ink path, which is performed after installing the image forming apparatus, has been disclosed in Jpn. Pat. Appln. KOKAI Publication No. 2007-007944. When initially filling the ink inside the recording head, the technique fills the ink by twice or more times and then prevents the ink from failing from the ink head and a cap covering the ink head to get a periphery dirty. Here, a sensor provided for the recording head detects whether or not the recording head has been already filled with the ink. When the sensor detects that the recording head has not been filled with the ink, a filling operation of the ink is further executed.

A technique in which heat generation from the recording head in image formation is cooled by circulating ink has been disclosed in Jpn. Pat. Appln. KOKAI Publication No. 2006-150745. In this technique, the ink is supplied to the recording head through a buffer tank having an air buffer so that a pulse of a pump which is used for ink circulation does not affect on an ejection pressure of the recording head. In image formation, a temperature monitoring system for the recording head monitors an under-image-formation circulation flag to be raised when it is determined that the recording head should be cooled. A technique, which operates a circulation pump only when the flag is raised to circulate the ink, and as a result, the recording head is cooled to a desired temperature by means of the ink passing through the recording head, has been proposed.

In a case in which the aforementioned circulation path of the ink is configured, to detect the actual circulation of the ink even in image formation, a detection means is needed, and for example, using a flow sensor is a possible approach. To confirm at which part of the circulation path the flow of the ink has stopped, the configuration mentioned above dispersively arranges a plurality of flow amount sensors on the circulation path, and applies control (detection processing, report, etc.) to each of flow amount sensors.

BRIEF SUMMARY OF THE INVENTION

The present invention provides a method for confirming ink circulation path and a method for filling with ink which is configured to confirm whether or not circulation of ink is appropriately performed through a configuration with a low cost.

According to an embodiment of the invention, there is provided a method for confirming ink circulation path, including: at least one recording head ejecting ink to forming an image; an upstream side tank with the ink filled therein; a downstream side tank with the ink filled therein; a first ink path which connects between the upstream side tank and the recording head; a second ink path which connects between the recording head and the downstream side tank; a third ink path which connects between the downstream side tank and the upstream side tank; and a sensor which detects a displacement amount of a parameter varying in response to an amount of ink in the downstream side tank, and circulating again the ink to the upstream side tank in order of the upstream side tank, the first ink path, the recording head, the second ink path, the downstream side tank, and the third ink path, the method comprising: a first ink supply process of supplying ink in the upstream side tank toward the downstream side tank through the first and the second ink paths; a second ink supply process of supplying ink in the downstream side tank toward the upstream side tank through the third ink path with a supply amount which is lager than a supply amount of ink in the first ink supply process; an ink supply stop process of stopping the second ink supply process when the displacement amount of the parameter is detected, and when it is detected that the parameter becomes from a first value to a second value which is smaller than the first value by detecting the displacement amount of the parameter while performing the first ink supply process and second ink supply process; a time measurement process of measuring a time until the parameter returns to the first value from execution of the ink supply stop process; and a comparison process of comparing whether or not a measured time in the time measurement process is not longer than a prescribed set time.

DETAILED DESCRIPTION OF THE INVENTION

Hereinafter, embodiments of the present invention will be described in detail with reference to the drawings.

Figure 1:
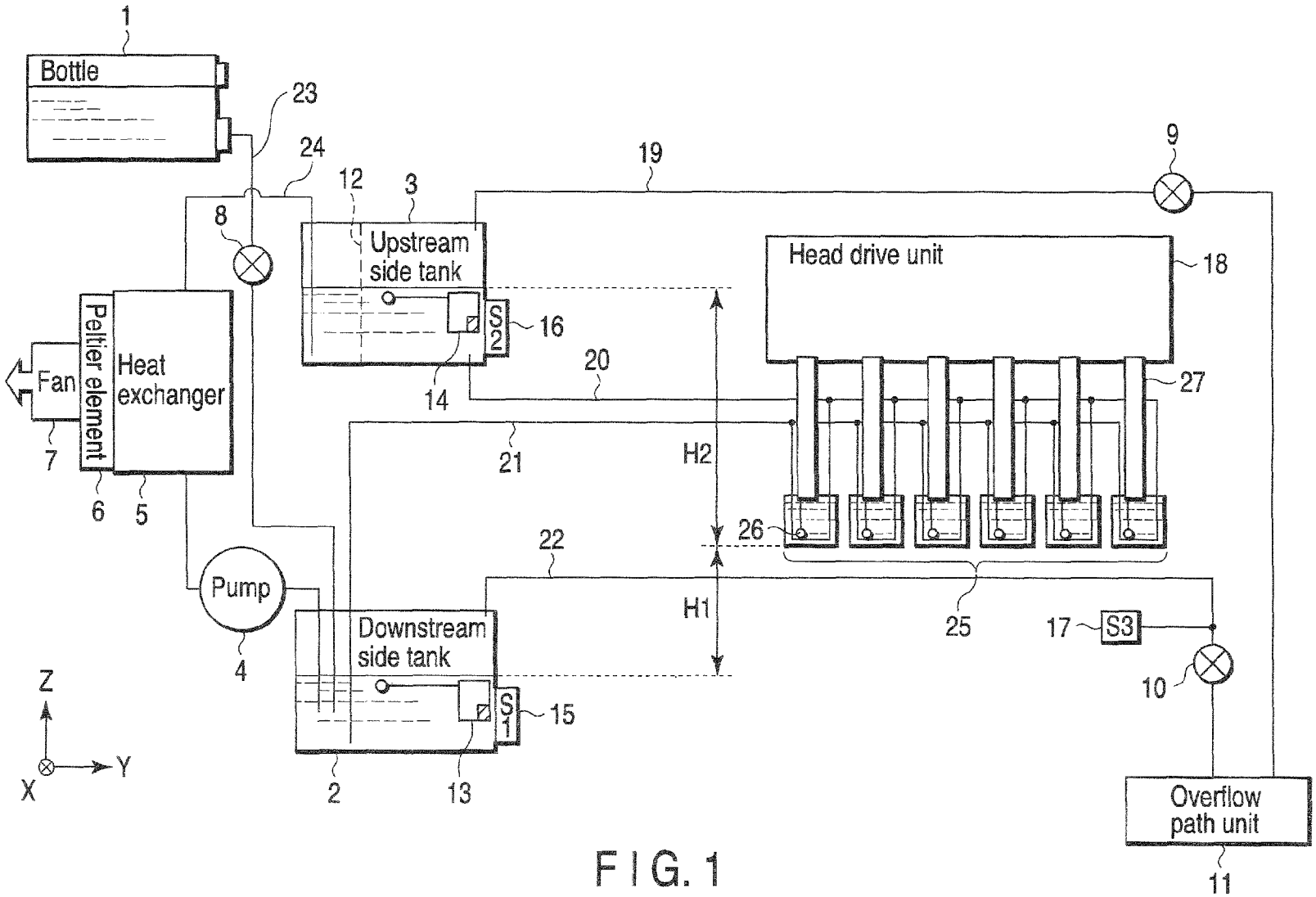
FIG. 1 is an exemplary view depicting a configuration example concerned with an ink circulation path of an image forming apparatus for achieving a method for confirming ink circulation path and a method for filling with ink as a first and a second embodiments of the invention.

FIG. 1 shows a configuration example related to an ink circulation path of an inkjet printer (image forming apparatus) for achieving a method for confirming ink circulation path and a method for filling with ink as a first embodiment of the invention. Hereinafter, only a configuration necessary for the first embodiment will be described, and although not shown in any figure, it is assumed that the embodiment includes configuration units (e.g., recording medium supplying mechanism, a carrying mechanism, a recording medium ejection mechanism, an operation unit, a display unit, and a control unit controlling a whole of an inkjet printer) which are provided for a usual inkjet printer. Each figure in the following each embodiment illustrates so that an x-axis direction shows a recording medium carrying direction by a horizontal direction, a y-axis direction shows a direction orthogonal to the recording medium carrying by a horizontal direction, and a z-axis direction shows up and down direction of a vertical direction.

The printer mainly comprises a plurality of recording heads 25 performing image formation; a head drive control unit 18 driving each recording head 25; an upstream side tank 3 supplying ink to the recording heads 25; a downstream side tank 2 storing ink to be returned which has not used for image formation; a pump 4 moving the ink from the downstream side tank 2 to the upstream side tank 3; a neat exchanger 5 adjusting temperatures of the ink; an ink refill tank 1 refilling ink which is short due to consumption in image formation to the downstream side tank 2; and an overflow path unit 11 of which the inside is an atmospheric pressure state.

Further, an ink circulation path is composed of an ink supply flow path 20 connected to the recording head 25 from the upstream side tank 3; a return flow path 21 connected to the downstream side tank 2 from the recording head 25; a moving flow path 24 connected to the upstream side tank 3 from the downstream side dank 2 through the pump 4 and the heat exchanger 5; and an ink refill flow path 23 connected to the downstream side tank 2 from the ink refill tank 1 through a valve 8. To supply air to make the inside of each tank 2, 3 equal to the atmospheric pressure, an air opening path 18 connected to an upper part of the upstream side tank 3 through a valve 9 of a normal closed type from the overflow path unit 11, and an air opening path 22 connected to an upper part of the downstream side tank 2 through a valve 10 of a normal open type from the overflow path unit 11 are connected to the tanks 2, 3, respectively. A pressure sensor 17 is disposed between the valve 10 and the downstream side tank 2 on the air opening path 22.

In this configuration, to perform atmosphere opening for the tanks 3, 2 through the opening paths 19, 22, respectively, the inside of the overflow path 11 is also opened to the atmospheric air. The opening paths 19, 22 each work so as to take in the spilled out ink through the paths 19, 22, and introduce spilled out ink to a waste liquid tank (not shown) through the overflow path 11 when an abnormal situation in which ink is spilled out from the tanks 3, 2 occurs.

In the downstream side tank 2 and the upstream side tank 3, the same type float units 13, 14 provided with floats which are attached in a cantilever manner so as to be rocked with one ends as a center and which house magnets with air sealed therein at the other ends, respectively. Position sensors (S1 sensor, S2 sensor) 15, 16 having read switches for detecting the magnets in the floats are arranged outside the tanks 2, 3, respectively. These S1, S2 sensors 15, 16 detect amounts of displacement of parameters displacing in response to amounts of the ink in the tanks 2, 3. S1, S2 sensors 15, 16 are attached so as to detect an appropriate amount of ink preset by each rocking float of the float unit 13, 14 at the positions by on and off of the sensors 15, 16.

Further, a filter 12 is provided in the upstream side tank 3 in order to remove foreign objects (mass of trash and ink, etc.) from the ink circulation paths so as to divide the inside of the tank 3.

A head drive control unit 18 for driving each recording head 25 is connected thereto through signal cables 27. Further, for example, thermistors are each disposed as temperature sensors 26 in the recording heads 25, respectively. In the heat exchanger 5, the ink circulation paths, composed of aluminum with excellent thermal conductivity, are configured. One face of a Peltier element 6 is bonded to the aluminum and the other face the Peltier element 6 is boded to a heat radiation means and the ink calculation path is heat-radiated and cooled. The heat exchanger 5 functions so that heat generation from the Peltier element 6 is applied to the ink through the heat exchanger 5 when the temperature of the ink is low, and so that a heat amount applied to the ink from the recording head 25 is taken by cooling the Peltier element 6 through the heat exchanger 5 when the temperature of the ink is high in order to fall the temperature of the ink flowing the recording head 25 into a prescribed range.

The pump 4 works to generate a negative pressure inside the downstream side tank 2 by driving the valve 10 in a closed state in addition to works to move the ink from the downstream side tank 2 to the upstream side tank 3. To make the level of the negative pressure constant, the pressure sensor (S3 sensor) 17 measures the pressure of the inside of the downstream side tank 2, feeds back the measurement result to a pump drive circuit (not shown), and applies PWM control to the revolution speed of the pump 4.

Figure 10:
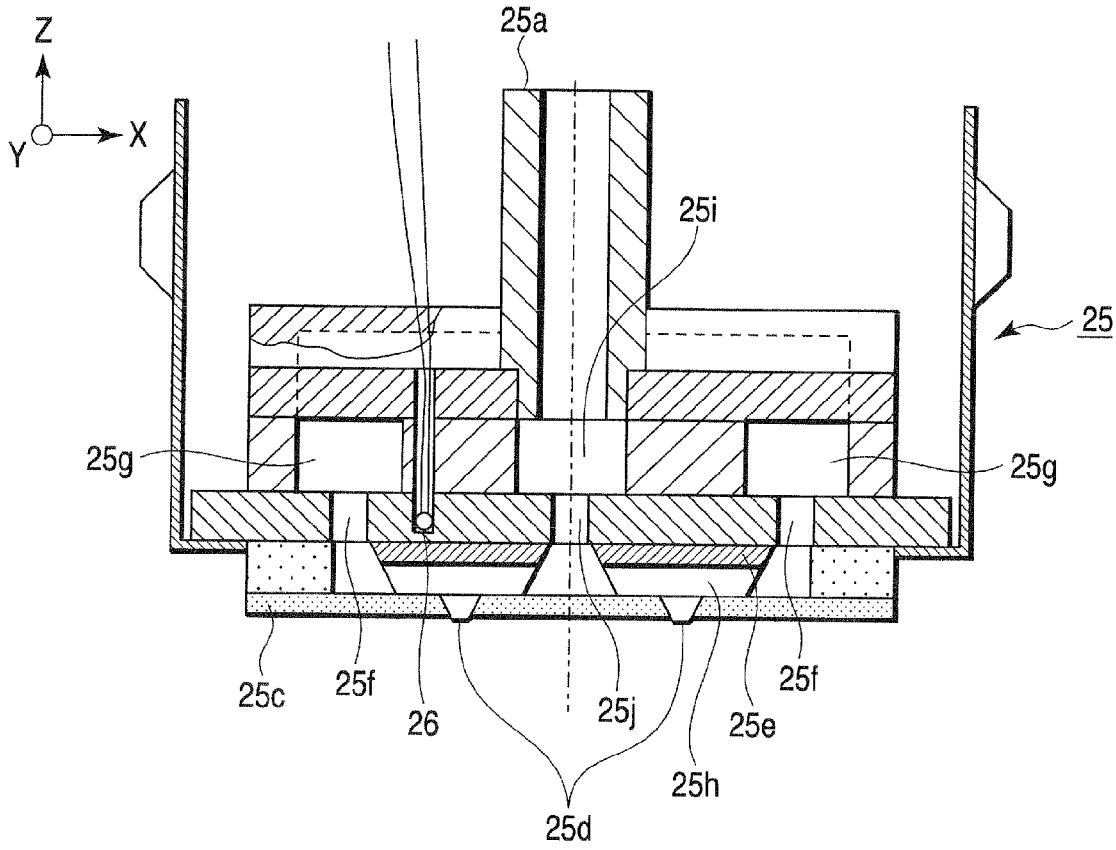
FIG. 10 is an exemplary view depicting a cross-sectional configuration of the recording head in the first to fifth embodiments.
Figure 11:
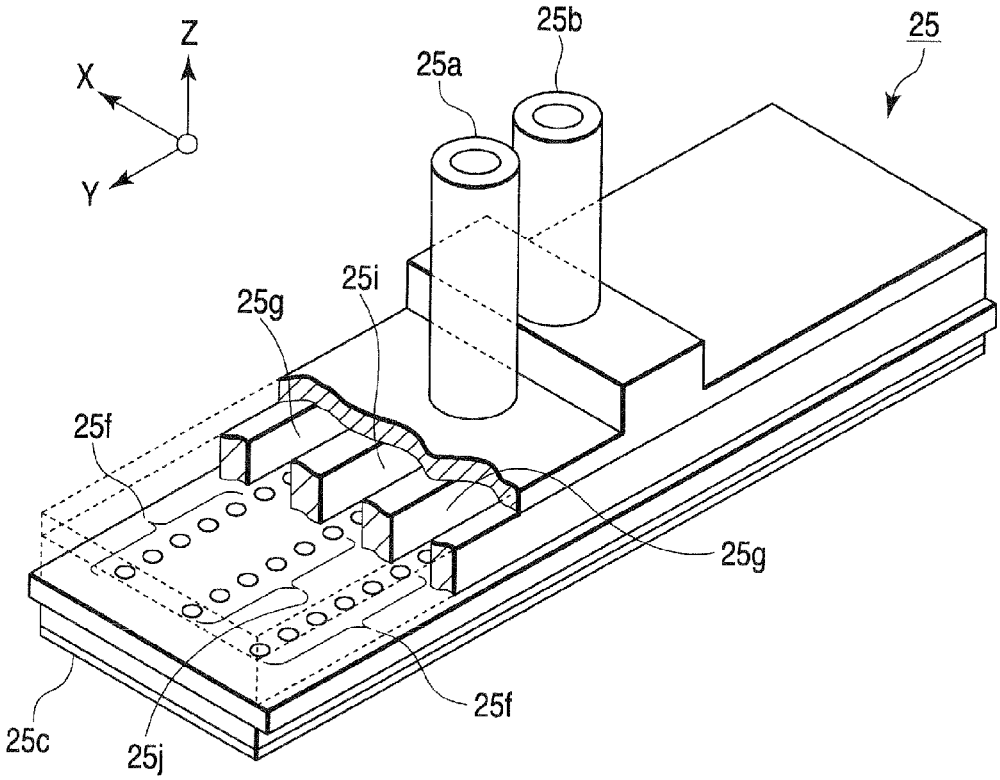
FIG. 11 is an exemplary view depicting a perspective exterior appearance configuration including the cross-sectional configuration of the recording head in the first to fifth embodiments.

Hereinafter, the configuration of the recording head 25 will be described by referring to FIGS. 10 and 11.

Each of the recording heads 25 has a length of a nozzle row shorter than the width of the recording medium, and may be arranged in turn so as to the nozzle row become orthogonal to the carrying direction for each color forming a color image. Also, each of the recording heads 25 has a length of the nozzle row shorter than the width of the recording medium, and a plurality of recording heads 25 may be arranged one after another so as to exceed the width of the recording medium in the width direction of the recording medium.

An approach route common flow path 25*i* and return route common flow paths 25*g* are arranged inside the recording head 25. Further, an ink inlet 25*a* for letting the ink flow into the flow path 25*i*, and ink outlet 25*b* for letting the ink which has not been used for the image formation flow from the flow path 25*g* are arranged on the upper face in the z-axis direction.

A nozzle plate 25*c* through with a plurality of nozzles 25*d* ejecting the ink are opened in a row manner disposed on the lower face in the z-axis direction of the recording head 25. Inner channel flow paths 25*h* formed of piezoelectric elements 25*e* are disposed at parts facing each nozzle 25*d* in the inside of the recording head 25. The ink flowed into from the inlet 25*a* passes though the flow path 25*i* and flows out from an ink outlet 25*b* through approach route holes 25*j*, the inner channel flow paths 25*h*, return path holes 25*f*, and return route common flow paths 25*g*. The flow paths 25*h* are formed in parallel grove shapes generate pressure waves due to the vibrations of wall parts forming the grooves, and ink drops are ejected from the nozzles 25*d* downward in the z-axis direction.

These elements 25*e* are symmetrically arranged with respect to the row of the approach route holes 25*j* line at the central part, and the nozzles 25*d* also disposed at the central part of inner channel flow paths 25*h* disposed at the elements 25*e*.

The ink flowed into from the inlet 25*a* branches into the flow paths 25*h* till coming near the outlet 25*b*, and flows while taking the heat generated from the elements 25*e*. A part of the ink is ejected from the nozzles 25*d* for the image formation.

The temperature sensor 26 indirectly detects temperatures near by the attachment units of the elements 25*e* as ink temperatures in order to measure the ink temperatures which flow the recording heads 25. Even when the temperatures near by the attachment units are indirectly measured, in a detection process in production, the temperatures may be corrected by calculating correction values on the basis of design or actual measurement.

The plurality of recording heads 25 are coupled to the supply flow path 20 and the return flow path 21, respectively, the ink inlet 25*a* is connected to the supply flow path 20 and the ink outlet 25*b* is connected to the return flow path 21. The nozzles 25*d* at each recording head 25 are opened in a plane nozzle plate 25*c*, and the nozzle plate 25*c* is disposed so as to face the recording medium at equal intervals.

The method for confirming ink circulation path and the method for filling with ink in the ink circulation path of the image forming apparatus configured in this way will be described hereinafter.

As shown in FIG. 1, the downstream side tank 2 is disposed so that a liquid surface position, at the time when the S1 sensor 15 turns on in a state in which the tank 2 stores an appropriate amount of ink, becomes a position which falls by distance H1 from the nozzle plate 25*c* of the recording head 25. The upstream side tank 3 is disposed so that a liquid surface position, at the time when the S2 sensor 16 turns on in a state in which the tank 3 stores an appropriate amount of ink, becomes a position which rises by distance H2 from the nozzle plate 25*c* of the recording head 25.

The ink supply flow path 20 and the return flow path 21 are composed of thick tubes of which the internal diameters are Φ5 mm and more, and designed so as to lower pressure losses in flow of the ink. A refilling bottle 1 is arranged as a position higher than that of the upstream side tank 3, and refills the ink into the downstream side tank 2 through the ink refilling flow path 23 in accordance with its own weight by opening the valve 8. The pump 4 moves the ink from the downstream side tank 2 to the upstream side tank 3 if necessary.

At this moment, the heat exchanger 5 exchanges the heat between the ink flowing into the recording head 25 and the Peltier element 6, and suppresses the temperature of the ink within a prescribed range. In this embodiment, the distance H1 of the downstream side tank 2 is set to around 50 mm, the distance H2 of the upstream side tank 3 is set to around 150 mm, and a target value of the negative pressure of atmosphere in the downstream side tank 2 is set to −4.5 kPa.

The relative density of the ink to be used is, for example, equal to around 1 g/cm$^3$. The viscosity of the ink differs from temperatures, for example, the viscosity varies 15 mPa·s at 15° C., 10 mPa·s at 25° C., 7 mPa·s at 35° C., and 5 mPa·s at 45° C. There is a head pressure difference of 200 mm between the downstream side tank 2 and the upstream side tank 3. As regards the pressure difference among air chambers of the recording heads 25, the upstream side tank 3 executes atmosphere opening, +1.5 kPa by a head pressure difference of 150 mm is applied to the nozzles 25*d*. With setting of the air chambers to −3.5 kPa by closing the downstream side tank 2, an air pressure −4.0 kPa and −0.5 kPa of head pressure difference 50 mm is applied to the nozzles 25*d*, and a negative pressure of −4.5 kPa is generated by putting together the pressure difference and the pressure difference of the air chambers. A flow path resistance inside the recording head 25 and a flow path resistance up to the recording head 25 may set a level of a negative pressure forming a meniscus of the ink at the nozzle 25*d*. In the embodiment, the flow path resistance is set so that the meniscus of the nozzle 25 becomes equivalent to −1.5 KPa.

The following will describe introducing operations in refilling the ink from the bottle 1 to the ink path.

After opening the valves 9, 10 to bring the upstream side tank 3, and the downstream side tank 2 into atmospheric pressure states, further the image forming apparatus opens the valve 8 to supplies the ink from the bottle 1 to the tank 2. This ink refilling raises the ink liquid surface in the tank 2, and the float 13 floats to turn on the S1 sensor 15. After turning on the S1 sensor 15, the apparatus shuts the valve 8 to stop ink refilling.

The apparatus then drives the pump 4 to pump up the ink from the tank 2 to the tank 3. When passing though a filter 12, large particles (mass of ink and foreign objects) are removed from the pumped up ink to be stored inside the upstream side tank 3. Even in the tank 3, the ink liquid surface is raised, the float 14 is floated, and the S1 sensor is turned on.

After the S2 sensor 16 turns on, the pump 4 stops its pump up operation. During this pump up operation, if the S1 sensor 15 turns off, the apparatus opens the valve 8 as needed to refill the ink from the bottle 1 to the downstream side tank 2. The apparatus repeats the ink refilling operations and the ink pump up operations, and when both the S1 sensor 15 and S2 sensor 16 bring into turn-on states, the apparatus completes initial filling to both tanks 2, 3. Upon completing the initial filling, the apparatus makes the valve 10 execute atmosphere opening, and closes the valve 9.

Upon completing the initial filling, a partial ink flows in the supply flow path 20, recording head 25 and return flow path 21 connected through the ink circulation paths, and many bubbles remain therein. More specifically, since the supply flow path 20 and the return flow path 21 use thick tubes, the air is not pushed to the downstream at a tube part disposed vertically, and the bubbles remain there frequently.

In such a situation, since the atmospheric part of the upstream side tank 3 is sealed with the valve 9, the ink does not naturally drop to the side of the recording head 25 by gravitation. Meanwhile, at the downstream side tank 2, the valve 10 is opened and the air chamber part is brought into the atmospheric pressure state. Originally, the inside of the recording head 25 and the return flow path 21 should be perfectly filled with ink, and the meniscus should be formed at the nozzle 25*d* of the recording head 25. However, because of the existence of the bubbles, the meniscus is broken and the ink drops from the nozzle 25*d*. Or, the air further gets in from the nozzle 25*d*, and increases the volume of the air inside the return flow path 21.

Therefore, the initial filling is performed in a state in which an ink pan (not shown) for receiving the ink dropped from the recording head 25 is applied to the nozzle 25 from the lower side of the recording head 25.

[Liquid Surface Detecting Operation]

Confirmation of an amount of ink after the initial filling, namely, ink liquid surface detection at the upstream side tank 3 and the downstream side tank 2 will be explained with reference to the flowchart of FIG. 5. Here, after ink refilling, the image forming apparatus performs bubble removing operations inside the supply flow path 20, recording head 25 and return flow path 21.

The apparatus determines whether or not an appropriate amount of ink has been stored in the upstream side tank 3 and the downstream side tank 2, that is, whether or not both the S1 sensor 15 and the S2 sensor 16 have been turned on (Step S1). In the determination, if both the S1 sensors 15 and the S2 sensor 16 have been turned on (YES, in Step S1), it is determined that the appropriate amount of ink has been stored, and the apparatus shifts to a confirmation flow of the next ink circulation path (Step S12 will be described later). Conversely, both or either of the S1 sensor 15 and the S2 sensor 16 have/has not been turned on (NO, Step S1), it is determined whether or not the S1 sensor 15 has been turned off (Step S2). In other words, it is determined whether or not the downstream side tank 2 is short of ink. In the determination, if the S1 sensor 15 has been turned off (NO, step S2), the apparatus opens the valve 8 (Step S3) to refill the ink from the refilling bottle 1 to the downstream side tank 2. At this moment, the valve 10 has been in an opening state.

Further, when the ink is refilled, a set time T0 preset at a timer is set to start count (Step S4). It is assumed that the timer is disposed at a control unit (not shown). Before a count time t reaches the set time T0, it is determined whether the S1 sensor 15 turns on or not (Step S5). If the S1 sensor 15 turns on before reaching the set time T0 (YES, Step 2), the apparatus closes the valve 8 (Step S8), stops refilling the ink to the downstream side tank 2, and returns to Step S1. Conversely, after the lapse of the set time T0, if the S1 sensor 15 does not turn on (NO, Step S2), it is determines that the refilling of the ink is not sufficient, the bottle 1 does not store the ink to refill, the apparatus closes the valve 8 so as to interrupt the ink refilling (Step S6). The apparatus then keeps the state, reports the fact of shortage of the ink in the bottle 1 to a user through voice guidance, a buzzer sound and/or an error display (Step S7).

In the determination in Step S2, if the S1 sensor 15 has been turned on (NO, Step S2), since the S2 sensor 16 has been turned off, the apparatus opens the valve 9 (Step S10), and brings the upstream side tank 3 into the atmospheric pressure state.

After this, the apparatus drives the pump 4 (Step S11), pumps up the ink in the downstream side tank 2 into the upstream side tank 3. The apparatus then shifts to Step S1, and determines again whether or not the amounts of ink in both the downstream side tank 2 and the upstream side tank 3 are appropriate. In a state in which both the S1 sensor 15 and S2 sensor 16 are turned on, the apparatus stops the pump 4, closes the valve 9 (Step S12), terminates the liquid surface detecting operation, and shifts to the confirmation operation of the next ink circulation path. Reporting the termination of the liquid surface detecting operation to the user through the voice guidance, the display on a display unit, etc., has the advantage of an aspect of user-friendliness.

According to the above mentioned routine, the apparatus detects the liquid surface level of the downstream side tank 2 and the upstream side tank 3 to confirm that appropriate amounts of ink are stored in the respective tanks 2, 3.

[Ink Circulation Path Confirming Operation]

The confirmation of the ink circulation path will be described by referring to the flowchart of FIG. 6. The ink circulation path indicates an ink circulation path through which the ink may flow by its own weight from the supply flow path 20 to the return flow path 21 through the recording head 25.

The image forming apparatus firstly opens the valves 9, 10, supplies the ink from the upstream side tank 3 by the own weight to the recording heads 25, respectively, and let the ink flow to the downstream side tank 2 through the recording head 25. The apparatus drives the pump 4 and pumps up the ink so as to refill the ink from the downstream side tank 2 to the upstream side tank 3 of which the amount of ink has been reduced (Step S21). The pump up amount of the pump 4 is set so as to become larger than the ink flow amount flowing into the downstream side tank 2. Since the ink is supplied from the downstream side tank 2 to the upstream side tank 3 until the S1 sensor 15 is brought into an off state from an on state by the operation of the pump 4, it is needed in designing to secure an air chamber capacity for storing the amount of the ink to be supplied.

The apparatus then determines whether or not the S1 sensor 15 of the downstream side tank 2 has turned off (Step S22). The pump up of the ink by the pump 4 is continued until the S1 sensor 15 turns off (NO, Step S22). Conversely, if the S1 sensor 15 has turned off (YES, Step S22), the apparatus stops the drive of the pump 4, sets a prescribed set time T1 to the timer, and starts the count (Step S23).

After this, it is determined whether or not the count time t by the timer exceeds the set time T1 (Step S24). The apparatus stops the drive of the pump 4, and lets the ink flow through the recording head 25 from the upstream side tank 3 due to the head pressure difference to the downstream side tank 2 through the return flow path 21 during count by the timer. The apparatus determines whether or not the S1 sensor 15 turns on by the count until the counted time t exceeds the set time T1 (Step S25).

In the determination in Step S25, if the S1 sensor turns on (YES, Step S25), the apparatus closes the valve 9 (Step S26), determines that the ink circulation path is in a normal condition, and shifts to an ink circulation operation mentioned below. Before shifting to the ink circulation operation, the apparatus may report the fact of normality as a result of confirmation of the ink circulation path to the user.

Conversely, if the S1 sensor 15 has not been turned on (NO, step S25), the apparatus determines the shortage of the amount of ink, returns to Step S24, and continues the count.

In a case in which there are many bubbles inside the supply flow path 20, return flow path 21 and recording head 25, since the ink does not flow smoothly, even when the set time T1 has elapsed, the S1 sensor 15 does not turn on, and the count time t passes the set time T1 in Step S24 (NO, Step S24). In this case, it is determined that the filling of the ink in the ink circulation path is not sufficient (there is abnormality in the ink circulation path), the apparatus closes the valve 9 (Step S27), and shifts a filling operation of ink described below. Before shifting to the ink filling operation, the apparatus may report the abnormality in the ink circulation path to the user.

In this way, by determining whether or not the ink flow amount flowing from the upstream side tank 3 to the downstream side tank 2 by the own weight of the ink reaches the prescribed amount or more within the prescribed set time T1, the apparatus may confirm whether or not the ink circulation path from the upstream side tank 3 to the downstream side tank 2 is in a normal condition.

[Ink Filling Operation]

Figure 7:
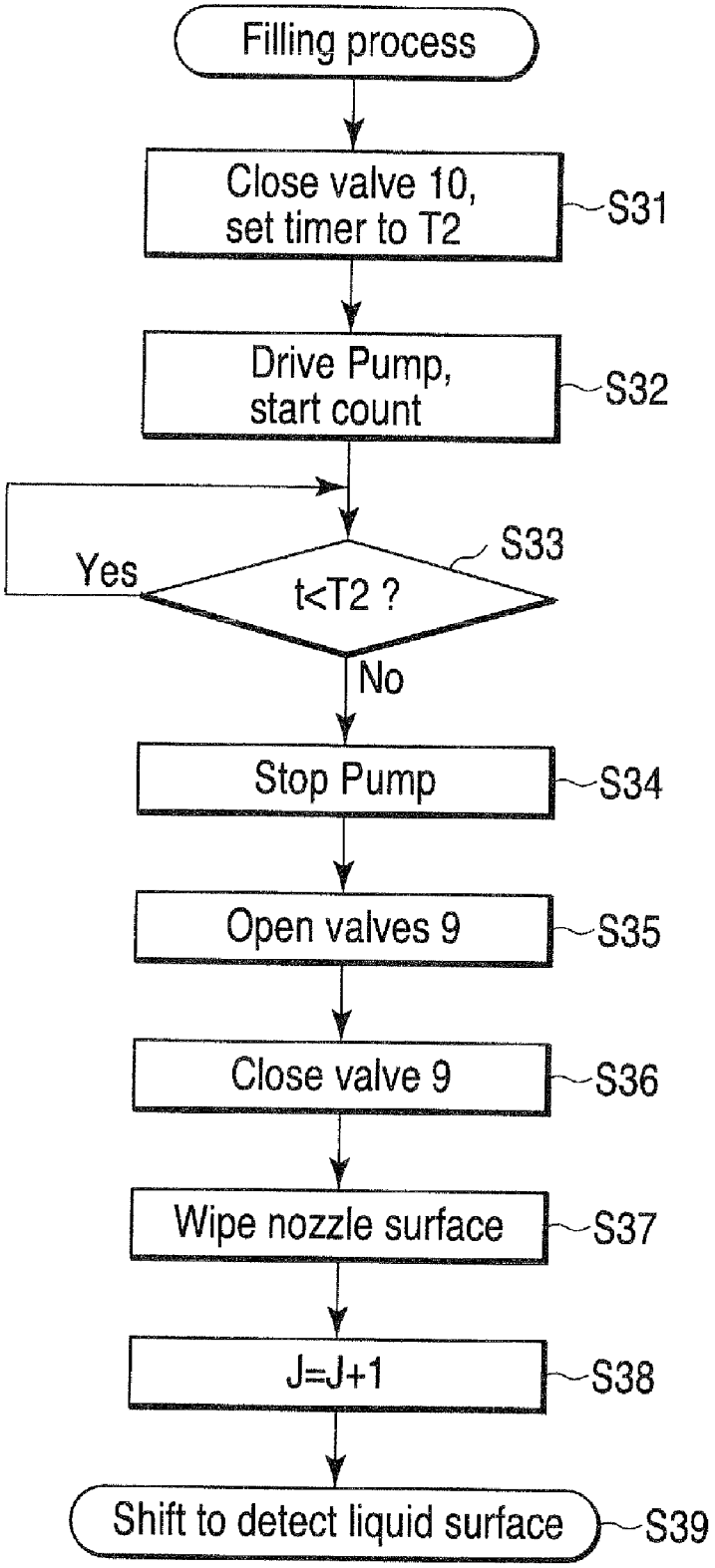
FIG. 7 is an exemplary flowchart for explaining a filling process operation in the first embodiment.

Ink filling operations will be described with reference to the flowchart of FIG. 7.

The image forming apparatus firstly closes the valves 9, 10 (however, the valve 9 has been closed and terminated in the ink circulation path confirming operation), and brings the ink circulation path into a sealed state. The apparatus sets a time T2 to the timer (Step S31). After timer setting, the apparatus starts to drive the pump 4 and starts to count the timer (Step S32). The apparatus determines whether or not the count time t reaches the set time T2 (Step S33), and continues the drive of the pump 4 until the count time t reaches the set time T2.

This set time T2 is set so as to prevent the air from getting into the ink circulation path from the downstream side tank 2 to the upstream side tank 3 because the liquid surface of the downstream side tank 2 is lowered too much due to the drive of the pump 4, and set on the basis of a manufacturing specification or by actual measurement of the ink circulation path. Since the ink is supplied to the upstream side tank 3 by means of the pump 4 in a state in which the ink circulation path of which the valve 9 is closed is in the sealed state due to the drive of the pump 4, the air chamber of the upstream side tank 3 generates a high positive pressure.

At this moment, the ink which flows from the upstream side tank 3 to the downstream side tank 2 is applied a pressure larger than the pressure difference at the time of usual circulation. For instance, in a case in which the air chamber of the upstream side tank 3 becomes a positive pressure of 10 kPa, and the air chamber of the downstream side tank 2 becomes a negative pressure of −5 kPa, a pressure difference of about 17 kPa by adding to the pressure difference 2 kpa. Since a positive pressure is applied to the recording head 25, the ink is flowed from the nozzle 25*d*. At the same time, the ink is sufficiently filled inside the recording head 25. Since the flow path resistance of the nozzle 25*d* is sufficiently larger than those of other flow paths, when the inside of the recording head 25 is filled with the ink once, although a small amount of ink is flowed out from the nozzle 25*d*, most of the ink is flowed out toward the downstream side tank 2. Because the flow rate at that time becomes fast, the babbles which have stayed in the flow paths and have not flowed are pushed out toward the downstream side tank 2 from the supply flow path 20 and the return flow path 21.

If the count time t reaches the set time T2 (NO, Step 33), the apparatus stops the pump 4 (Step S34). After stopping the pump 4, the apparatus opens the valves 9, 10 once (Step S35), each executes atmosphere opening of the upstream side tank 3, and the downstream side tank 2 to return the pressure in the air chambers to the atmosphere pressure state. Then, the valve 9 is closed (Step S36). When the valve 9 is closed, since the air does not flow into the upstream side tank 3, the ink is not supplied to the recording head 25. By driving a wipe mechanism (not shown), the ink flows out from the nozzle 25*d*, and wipes redundant ink which has adhered to the nozzle plate 25*c* (Step S37). After wiping, the ink at the nozzle 25*d* is applied the negative pressure due to the liquid surface head pressure difference of the downstream side tank 2, and the meniscus is formed. The apparatus then performs inclement processing for adding one to the number of detection times J (Step S38), and performs the liquid surface detection operation again (Step S39).

In this way, the bubbles existing inside the supply flow path 20, the return flow path 21 and the recording head 25 are pushed out to the downstream side tank 2, and the ink is filled into the ink circulation path.

While the aforementioned example has driven the pump 4 by closing the valves 9, 10, some flow path configurations may make the ink pressure at the nozzle position of the recording head 25 become the negative pressure due to the negative pressure of the downstream side tank 2, and the case may suck in the air from the nozzle 25*d*. In such a case, performing the same operation while keeping the valve 10 open enables the nozzle 25*d* to keep at a positive pressure and push out the bubbles in the return path 21 to the downstream side tank 2.

[Ink Circulation Operation]

The following will describe the ink circulation in the ink circulation path.

Figure 13:
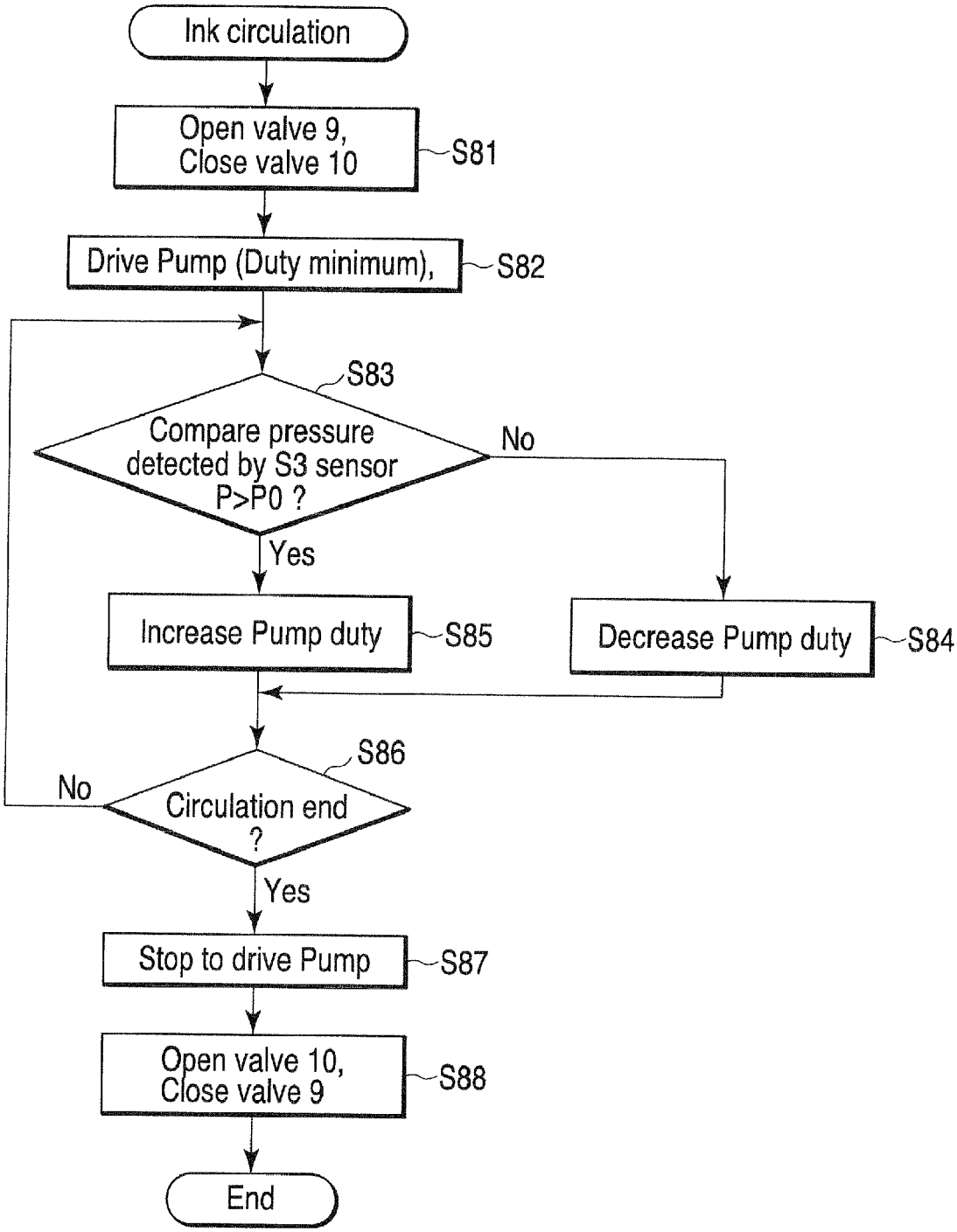
FIG. 13 is an exemplary flowchart for explaining circulation in a state in which ink normally flows on the ink circulation path in the first embodiment.

The circulation in a state in which the ink normally flows in the ink circulation path will be described with reference to flowchart shown in FIG. 13.

In the ink circulation path confirming operation (refer to FIG. 6), in a case in which the ink circulation path is in the normal condition (in a case of [YES], in Step S25); the ink circulation operation is started.

Since the valve 10 has been opened, the air chamber of the downstream side tank 2 is roughly brought into the atmosphere pressure state. In this state, the apparatus firstly opens the valve 9 and closes the valve 10 (Step S81). Since the ink liquid surface of the downstream side tank 2 is set to a position which is lower than the that of the nozzle 25*d* by 50 mm, but the ink liquid surface of the upstream side tank 3 is set to a position which is higher than that of the nozzle 25*d* by 150 mm, opening the valve 9 results in addition of a positive pressure to the nozzle 25*d*. However, since the valve 10 is closed, and the ink liquid surface of the downstream side tank 2 is set to a lower position, a strong positive pressure is not applied to the nozzle 25*d*, and the ink does not flow put from the nozzle 25*d* immediately.

After this, the apparatus starts to drive the pump 4 with a duty minimum (Step S82). For instance, in a case in which the apparatus drastically loads a heavy drive load, a high negative pressure is suddenly generated in the downstream side tank 2, and the nozzle 25*d* of the recording head 25 may suck the air. So as prevent such a case, the drive load on the pump 4 at the time of a circulation start is set to a minimum.

After the lapse of a short while after opening the valve 9 and closing the valve 10, the drive of the pump 4 is started, the ink in the downstream side tank 2 is pumped up, and then, the air chamber pressure of the downstream side tank 2 is gradually decreased in pressure to be a negative pressure. Here, it is determined whether or not an actual measurement value P measured by the S3 sensor 17 is larger than a set value P0 of the air chamber pressure of the downstream side tank 2 (Step S83). For instance, it is assumed that the set value P0 of the air chamber pressure of the downstream side tank 2 is set to −4 kPa. If the actual measurement value P is not larger than the set value P0, that is, if the actual measurement value P becomes closer to a negative pressure than the set value P0 of −4 kPa (NO, step S83), a duty of the pump 4 is decreased (Step S84). The decrease in duty further approximates the air chamber pressure of the downstream side tank 2 to the set value P0 (−4 kPa). If the actual measurement value P is larger than the set value p0, namely if the actual measurement value p is becomes closet to the positive pressure than the set value P0 (−4 kPa) (YES, Step S83), conversely, the apparatus increases the duty of the pump 4 (Step S85). Performing such feedback controlling controls the apparatus so that the air chamber pressure of the downstream side tank 2 converges on the set value P0 (−4 kPa). Since an ink flow amount from the upstream side tank 3 is too much in comparison with an ink pump up amount by the pump 4 driven by the duty minimum at first of the ink circulation start, the apparatus determines in Step S83 at [YES] for a little while. Therefore, the duty of the pump 4 gradually increases for a while after starting the ink circulation.

During feedback control of the duty of the pump 4 and during control the pressure of the air chamber so as to be constant, the ink liquid surface height of the downstream side tank 2 does not vary and the volume of the air chamber does not also vary. That is, since the pump 4 pumps up almost the same amount of the amount of ink to be supplied from the upstream side tank 3 to the downstream side tank 2 passing through the recording head 25, the air chamber pressure of the downstream side tank 2 is maintained at around −4 kPa.

During the duty control of the pump 4, if a command of ink circulating termination which instructs refilling completion to be issued from a system when the apparatus terminates print or stands by (YES, Step S86), the apparatus stops to drive the pump 4 (Step S87), opens the valve 10 and closes the valve 9 to enter a normal standby state for the image formation.

If the command of ink circulating termination is not issued (NO, in Step S86), since the ink refilling has not completed yet, the apparatus returns to Step S83 and continues the duty control of the pump 4.

In a case of image formation during ink circulation, with ink ejection from the recording head 25, the amount of ink decreased and the ink liquid surface of the Upstream side tank 3 lowers. At this time, the S2 sensor 16 functions as a sensor for detecting the increase or decrease in amount of ink in the upstream side tank 3. When the S2 sensor 16 turns off, it is determined that the amount of ink becomes short, the valve 8 is opened, and the ink is refilled to the downstream side tank 2 from the refilling bottle 1 through the ink refilling flow path 23. The downstream side tank 2 generates a slight pressure increase due to an increase in amount of ink; the S3 sensor 17 detects the pressure increase, and feeds back the duty of the pump 4. As a result, the duty of the pump 4 is increased, the ink is pumped up to the upstream side tank 3, the ink liquid surface of the downstream side tank 2 immediately returns to an original position. After this, if the S2 sensor 16 turns on due to the ink refilling to the upstream side tank 3, the apparatus closes the valve 8 to terminate the ink refilling.

The change in ink liquid surface of the upstream side tank 3 due to such an operation is limited only up to the height by which the S2 sensor 16 turns from an off state to an on state. In the embodiment, the change in liquid surface is within almost 10 mm, and if the change is converted into pressure, the change is equivalent to a variation by 0.1 kPa. If the air chamber pressure in the downstream side tank 2 does not change, the liquid surface of the upstream side tank 3 is opened toward the atmosphere, since only a slight variation is made as mentioned above, the pressure to be applied to the nozzle 25*d* hardly varies, even in the middle of the ink refilling, the nozzle 25*d* may stably eject the ink, the apparatus has no problem for the image formation.

Since the float of the S1 sensor 15 hardly moves up and down in image formation, the apparatus cannot detect the ink liquid surface in the downstream side tank 2 at real time. Since the sensor 16 of the upstream side tank 3 does not move in a state in which the recording head 25 does not eject any ink, and the ink is hardly consumed, the apparatus also cannot recognize the ink liquid surface of the upstream side tank 3.

Therefore, even when any one of such abnormalities, as a state of leakage of the ink, a state in which the ink hardly circulates in the flow path because the babbles get in the path and a state in which the ink does not flow because the channel 25*h* part of the recording head 25 is blocked occur during image formation, it becomes hard for the apparatus to detect the abnormality.

Figure 5:
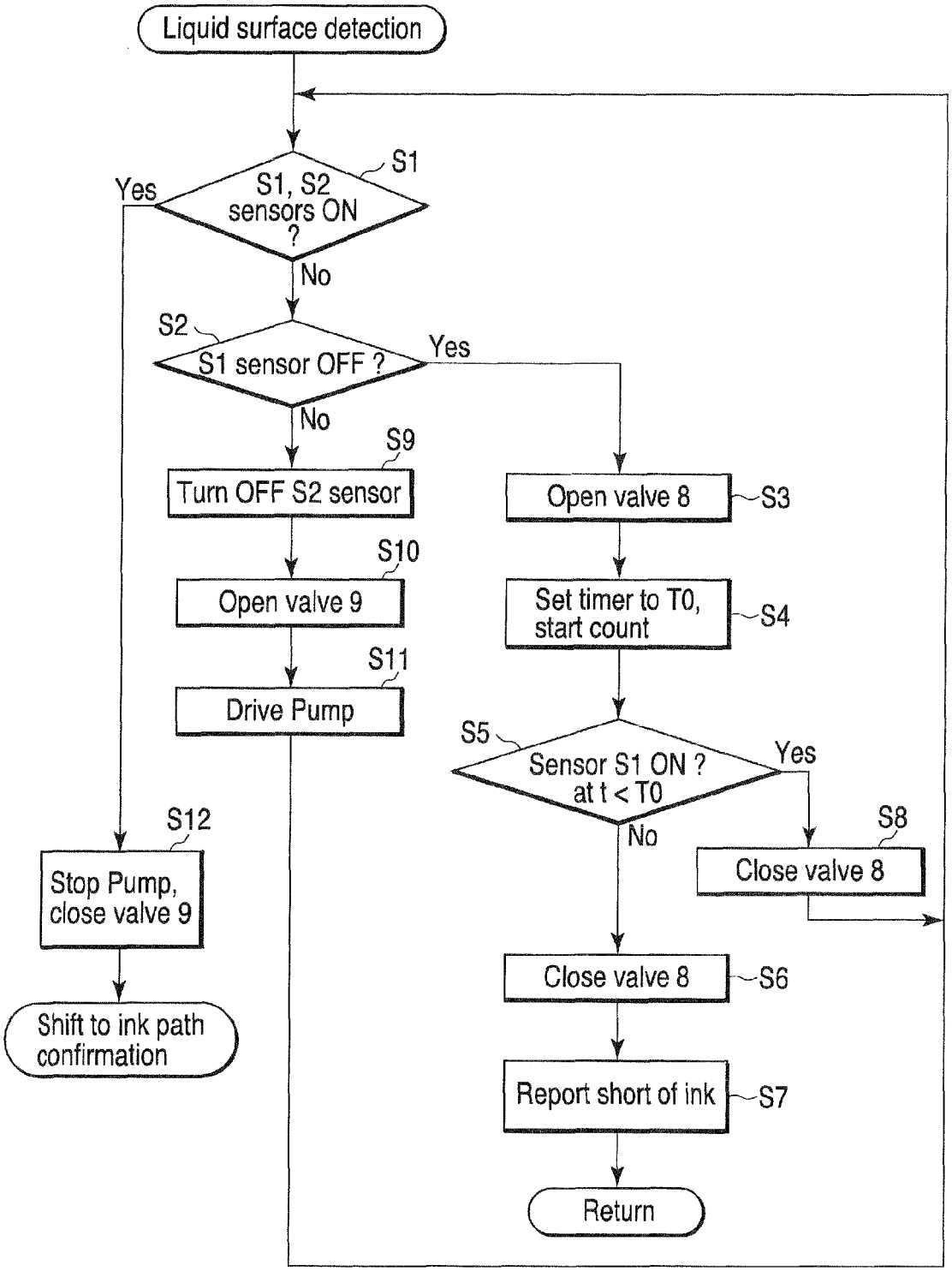
FIG. 5 is an exemplary flowchart for explaining confirmation of an amount of ink after initial filling, that is, liquid surface detection in an upstream side tank and a downstream tank of the first embodiment.
Figure 6:
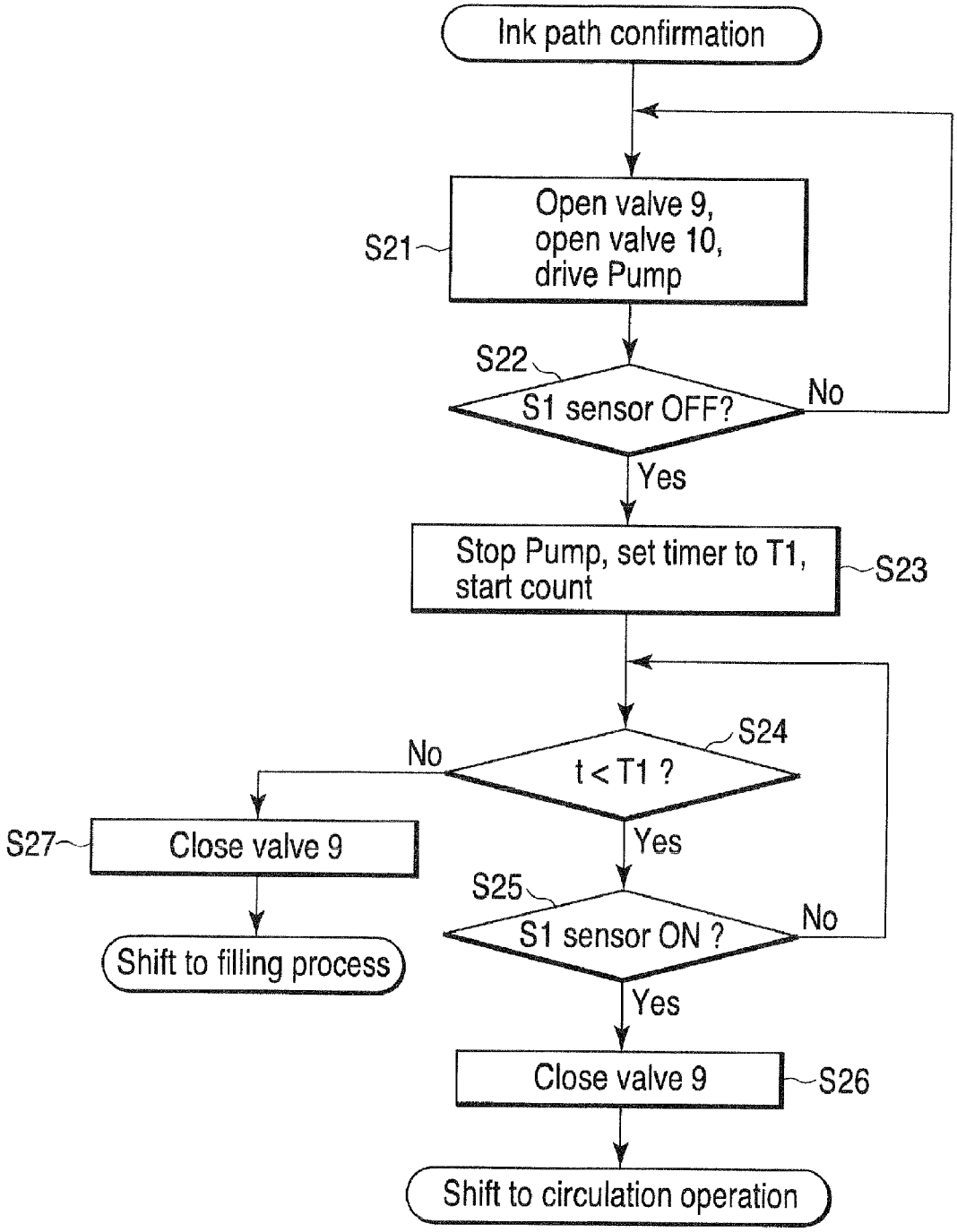
FIG. 6 is an exemplary flowchart for explaining confirmation of an ink path in the first embodiment.

To reduce such a risk, as mentioned above, it is preferable to confirm, before performing the circulation operation, whether or not the ink circulation path is in a state in which the ink can circulate before image information by performing the operation of the liquid surface detection and confirmation of the ink circulation path shown in FIGS. 5 and 6.

In this way, according to the embodiment, determining whether or not the amount of the ink flowing from the upstream side tank 3 to the downstream side tank 2 by the own weight of the ink reaches the prescribed amount or more within the prescribed set time T1 enables confirming whether or not the ink circulation path from the upstream side tank 3 to the downstream side tank 2 is normal.

According to the embodiment, before image formation, the apparatus may confirm the ink circulation path. Especially, it is preferable for the apparatus to execute the ink circulation path confirming operation at timing when the apparatus has not received the image formation command such as a time of just after the start up by turning on the apparatus, and a standby time between an image formation A and an image formation B.

A modified example of the confirmation of the ink circulation path will be described hereinafter.

Figure 8:
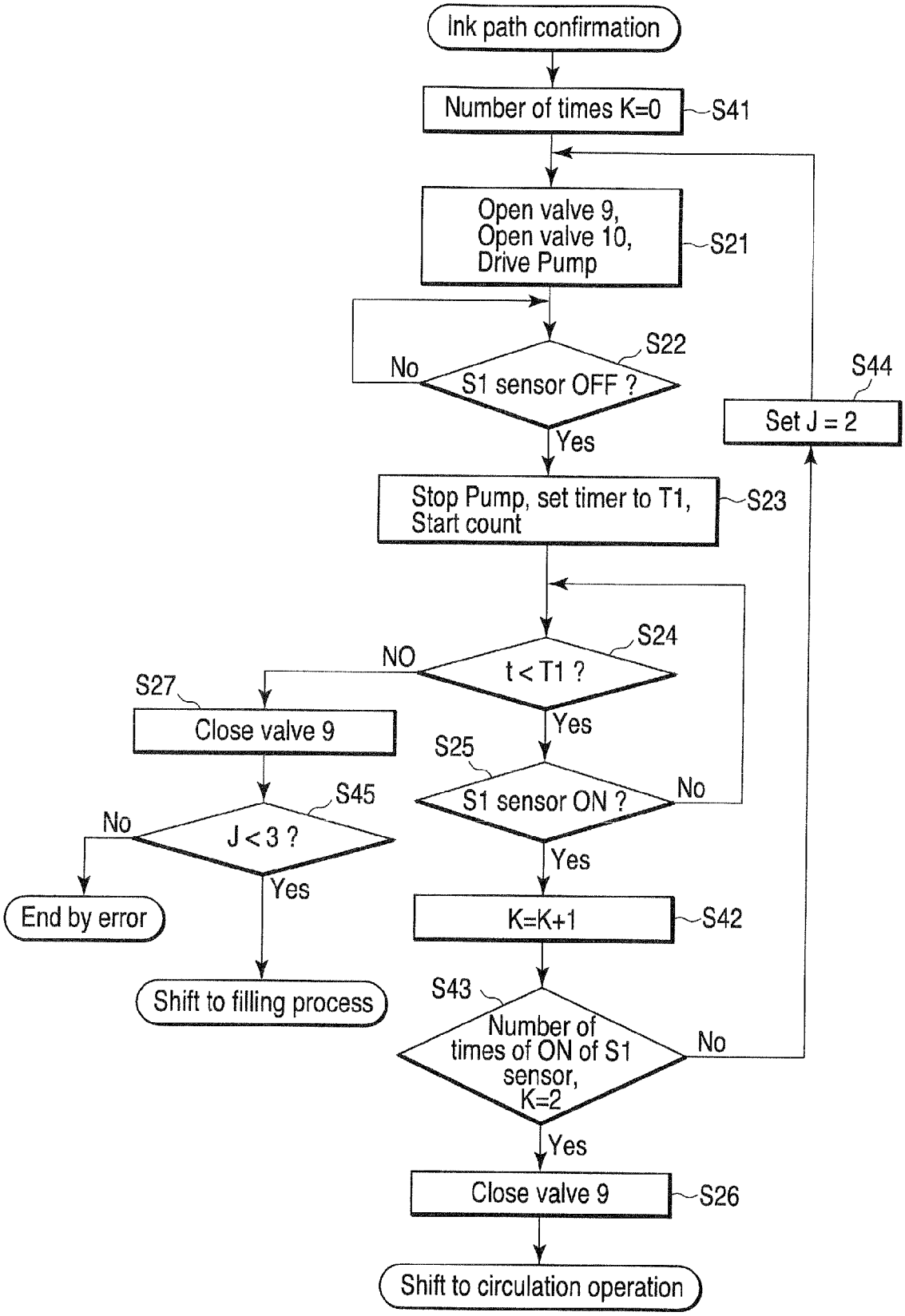
FIG. 8 is an exemplary flowchart depicting a modified example of a flow in FIG. 6 in the first embodiment.

FIG. 8 shows a modified example of the flowchart of FIG. 6. The modified example differs from the confirmation of the ink circulation path of FIG. 6 in an aspect in which the apparatus repeats more than once to confirm the number where the S1 sensor 15 turns on. In the flowchart shown in FIG. 8, processes deferring from those of the flowchart of FIG. 6 will be explained, and the same processes are put the same step numbers as those of FIG. 6, and the detail thereof is omitted.

The apparatus firstly sets K=0 (Step S41). Here, K indicates the number of times where the output from the S1 sensor 15 varies its state from off to on in the ink circulation path confirming operation.

The apparatus then each opens the valves 9, 10, drives the pump 4 (Step S21), and refills the ink into the upstream side tank 3 (now, the valve 10 is still open after the previous process). If the S1 sensor 15 turns off (Step S22), the apparatus stops the drive of the pump 4 (Step S23). When the pump 4 is stopped to be driven, since the valves 9, 10 are each open, the ink in the upstream side tank 3 flows toward the downstream side tank 2 through the recording head 25 by the own weight of the ink. The apparatus starts to count the timer at the same time when the pump 4 stops driving and sets the set time t1. The timer counts until the timer count t reaches the set time T1 (Step S24), and it is determined whether or not the S1 sensor 15 maintains the on state during count (Step S25).

If the S1 sensor 15 is turned on in the determination (YES, Step S25), the timer increments the number of times K (K=K+1) (Step S42), after this, the apparatus determines whether or not the number of times K becomes 2 (Step S43), if K=2 is sufficient (YES, Step S43), the apparatus closes the valve 9 (Step S26), and shifts to the foregoing circulation operations. Meanwhile, the confirmation of the ink circulation path is performed for the first time, and if the number of times K is 1 (NO, Step S43), the apparatus sets the number of times of filling processing J to 2 (Step S44), and returns to Step S21 in order to confirm the ink circulation path again. If the S1 sensor 15 turns on again in Step S25, the timer increments the number of times K to set as k=2 in Step S42. Then, it is determined YES in Step S43, the apparatus closes the valve 9 (Step S26) and shifts to circulation operations.

Conversely, if the S1 sensor 15 does not turn on within the set time T1 (NO, Step S24), the apparatus closes the valve 9 (Step S27), confirms the number of times of filling processes J (Step S45). The number of times of the filling processes J is incremented by 1 for every filling process of FIG. 7.

If the number of times of filling processes J is set to 3 or less (J<3) (YES, Step S45), the apparatus shifts to the filling process again (refer to FIG. 7). If the number of times of the filling processes has reached 3 (NO, Step S45), the apparatus determines that an important failure which cannot fill the ink in the ink circulation paths (supply flow path 20, return flow path 21, recording head 25, etc.), reports the fact of the existence of abnormality to the user, and terminates the ink circulation path confirming operations.

In this way, according to this modified example, even when it is determined that the ink circulation path is normal, the apparatus does not immediately shift to the circulation operations, after determining that the ink circulation path is normal in a plurality of numbers of times, and then, the apparatus shifts to the circulation operations. Therefore, in a case in which the flow of the ink in the ink circulation path is unstable, if the S1 sensor happens to turn on, the apparatus does not immediately determine that the ink circulation path is normal. Thereby, it becomes able to accurately determine whether or not the ink circulation path is normal, and the reliability is improved.

Next, the second embodiment will be described.

The second embodiment is characterized of a method for detecting whether or not the ink circulation path is normal, namely, whether or not the ink circulation state is normal during execution of the image formation while performing the ink circulation.

As mentioned above, the viscosity of the ink varies depending on a surrounding temperature such as a room temperature, etc. In the embodiment, since the ink is circulated while maintaining the air chamber pressure, the difference in pressure for letting the ink flow from the upstream side tank 3 to the downstream side tank 2 is almost constant regardless of the temperatures. For instance, the difference in pressure is 6 kPa.

Varying the viscosity of the ink due to the change in surrounding temperature varies the amount of ink corresponding to the surrounding temperature. For instance, the flow amounts at the ink temperatures of 15° C., 25° C., 35° C., and 45° C. are 2 mil/sec, 3 ml/sec, 4.5 ml/sec, and 5.5 ml/sec, respectively if the amount of ink flowing to the downstream side tank 2 at these ink temperatures is uniquely decided, the duty of the pump 4 for returning the same amount of ink to the upstream side tank 3 through the pump 4 is also uniquely decided. Accordingly, the apparatus may create a table in which relations among ink temperatures and the duty of the pump 4 are defined in the control unit (not shown), and predict the viscosity and amount of ink by using the measured ink temperatures.

The temperatures of the ink may be detected by temperature sensors disposed in the ink circulation paths. In the embodiment, the image forming apparatus utilizes the temperature sensors 26 disposed to control drive voltages for the recording heads 25 without newly disposing temperature sensors. The sensors 26 may be disposed at positions, near by piezoelectric elements in the recording heads 25, where the temperatures of the ink may be detected. Since the viscosity of the ink does not extremely differ in difference of temperatures of several degrees, errors within 2-3° C. may be allowed. Therefore, each of the temperature sensor 26 has degree of freedom in position for placing in the recording head 25; it is enough for the position where is near by the ink circulation path and to enable detecting the ink temperature.

A method for confirming the ink circulation path during ink circulation in image formation, etc., will be explained by referring to a flowchart shown in FIG. 14. While a procedure in the ink circulation in the embodiment is roughly same as that of the flow of the ink circulation of FIG. 13, the embodiment differs in a point where it is determined whether or not the ink circulation path is normal in comparison between the appropriate duty of the pump 4 to be calculated from the ink temperature and the duty of the pump 4 to be actually measured, and the embodiment is characterized by the different point.

The apparatus firstly opens the valve 9 and closes the valve 10 (Step S91). After this, the apparatus sets a time T5 to the timer (Step S92). At the time T5 is a time until the duty of the pump 4 in ink circulation becomes stable, and is appropriately set in manufacturing. Of cause, it is able to adjust the time T5 in response to the performance of the pump 4 and to the ink. After setting the time T5, the apparatus starts to drive the pump 4 with the duty minimum, and starts to count (Step S93).

The apparatus then determines whether the actual measured value P measured by the S3 Sensor 17 is larger than the set value P0 of the air chamber pressure of the downstream side tank 2 (Step S94). In this determination, if the actual value P is not larger than the set value P0 (NO, Step S94), the apparatus decreases the duty of the pump 4 (Step S96). Conversely, if the actual measured value P is larger than the set value P0 (YES, Step S94), the apparatus inversely increases the duty of the pump 4 (Step S95). Performing such feedback control controls the apparatus so that the air chamber pressure of the downstream side tank 2 becomes a constant value, for example, converges to −4 kPa.

The apparatus determines whether or not the count by the timer exceeds the set time T5 (Step S97). If it is determined that the count exceeds the set time T5 (YES, Step S97), the apparatus is not refilled the ink from the bottle 1. The apparatus also determines whether the recording head 25 is brought into a state of non-ejection of the ink (Step S98). If the ink refilling from the bottle 1 is not performed (valve 8 is open), or the ink is ejected from the recording head for image recording (NO, Step S98), the apparatus returns to Step S94.

If the ink is not refilled in the determination of Step S98 (valve 8 is closed), and at a timing when the ink is not ejected from the recording head 25 (YES, Step S98), the apparatus compares the set duty D of the pump 4 with an appropriate duty f(T) to be calculated on the basis of the ink temperature obtained from the temperature sensor 26 (Step S99). The appropriate duty f(t) has a width (range), and wherein, the appropriate duty f(t) is set in a range from 0.9×f(T) to 1.1×f (T) that is, in Step S99, it is determined whether or not the currently set duty D of the pump 4 is within a rage of ±10% of the appropriate duty f(T) calculated on the basis of the ink temperature, if the duty D is out of the range (NO, Step S99), it is determined that the ink circulation condition is abnormal to stop driving the pump 4 (Step S100).

In this abnormality, if the duty D of the pump 4 is lower than 90% of the calculated appropriate duty f(T), it is determined that the flow of the ink is in a bad situation. That is, a state in which a large mass of air, etc., is existence in the ink circulation path from the upstream side tank 3 to the downstream side tank 2, and a state in which the ink circulation path is blocked are assumed. Conversely, if the set duty D is larger than 110% of the calculated appropriate duty f(T), the apparatus determines that larger duty is required in order to maintain the negative pressure of the air chamber in the downstream side tank 2, and pays attention to the leakage of the air from the ink circulation path. In any case, the apparatus determines the existence of the abnormality in the ink circulation path.

In this way, when it is determined that the ink circulation path condition is abnormal, the apparatus opens the valve 10, closes the valve 9, arranges the ink pan (not shown) below the recording head 25, and even when the ink drops from the nozzle 25*d*, receives the ink by the ink pan so as not to get the apparatus dirty (Step S101). After this, the apparatus reports that the ink circulation status is abnormal.

If it is determined that the duty D is within a range of ±10% of the appropriate duty f(T) (YES, Step S99), the ink circulation is assumed to be normal, the apparatus determines the termination of the ink circulation (determination whether or not the ink circulation termination command has been issued from the system) (Step S102), if the command is not issued for the termination of the ink circulation (NO, Step S102), returns to Step S94. If the determination is the termination of the ink circulation (YES, Step S102), the apparatus stops to drive the pump 4 (Step S103), opens the valve 10, closes the valve 9 (Step S104), and brings the apparatus itself into a recordable state to terminate the ink circulation, According to the ink circulation operations, the apparatus may determine whether the circulation flow amount meets the ink temperature by determining whether or not the duty D of the pump 4 to be actually measured is within the appropriate duty f(T) corresponding to the ink temperature output from the temperature sensor 26, and if the flow amount meets the ink temperature, the apparatus may determine that the ink circulation is normal and if it does not meet the temperature, the apparatus may determine that the ink circulation is abnormal.

Since the apparatus determines whether or not the ink circulation path is abnormal after the lapse of the fixed time T5 from the start of the drive of the pump 4, the apparatus may ignore a failure in ink circulation due to an unstable operation which may occurs at initial drive of the pump 4. That is, since the apparatus determines when the ink circulation operation becomes stable to some extent, detection with high precision may be achieved.

As mentioned above, according to the embodiment, the image forming apparatus may detect whether or not the status of the flow of the ink is normal even in image formation with the ink circulation, and may prevent bubble suction and ink leakage while maintaining the pressure for ink ejection in an appropriate range.

The following will explain a third embodiment.

Figure 2:
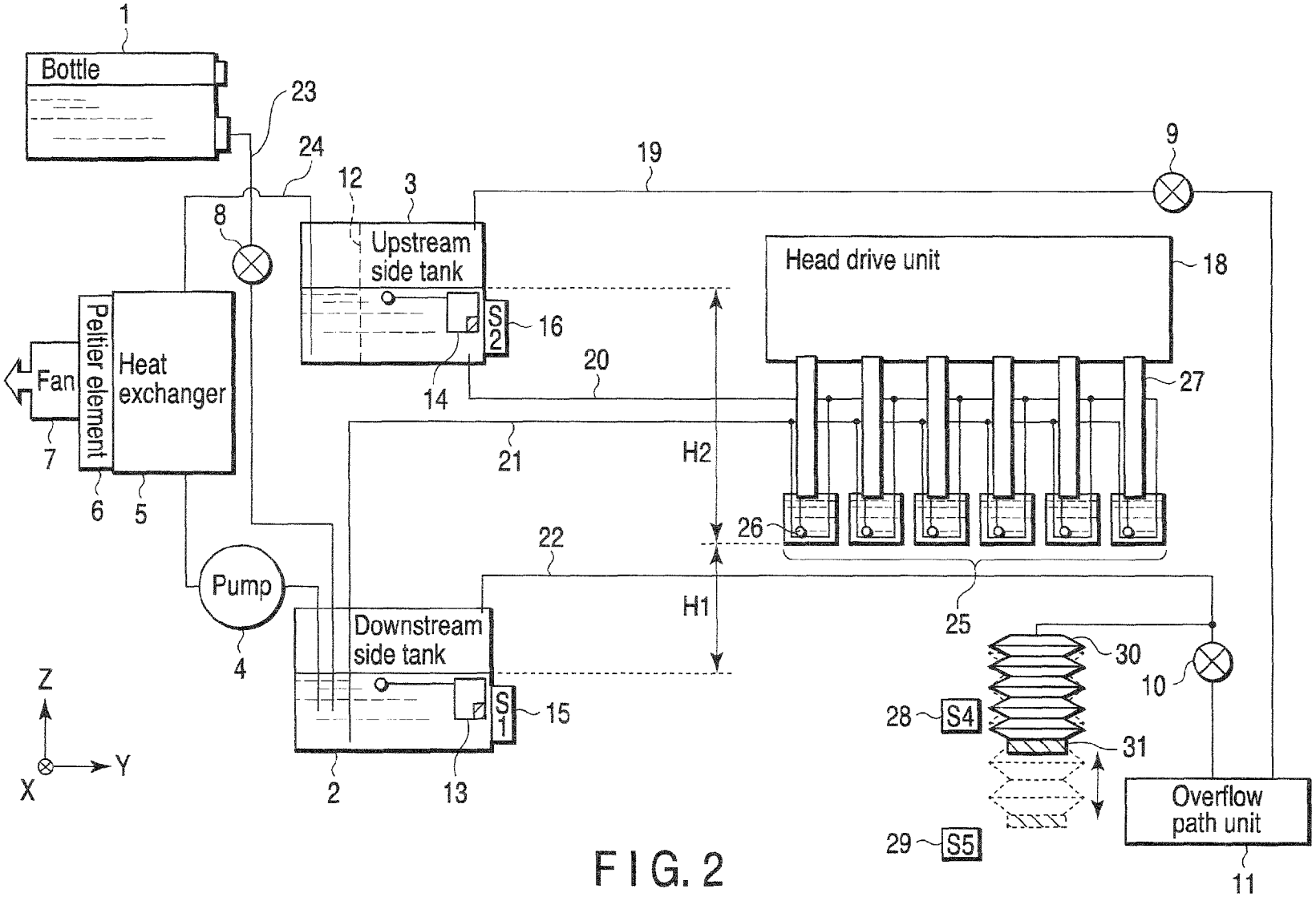
FIG. 2 is an exemplary view depicting a configuration example concerned with the ink circulation path of the image forming apparatus for achieving the method for confirming the ink circulation path and the method for filling with the ink as a third embodiments of the invention.

FIG. 2 shows a configuration example related to an ink circulation path of an inkjet printer for achieving a method for confirming a method for confirming ink circulation path and a method for filling with ink as a third embodiment of the invention. Also in FIG. 2, similarly to the first embodiment, it is assumed that the ink circulation path has constituent units which have been provided for a usual image forming apparatus. In the constituent units of the third embodiment, the units equivalent to the constituents of the first embodiment are designated by the identical reference symbols and explanations thereof are omitted.

The third embodiment differs from the foregoing first embodiment in that the third embodiment includes a negative pressure bellows 30 and two position sensors (S4 sensor, S5 sensor) 28, 29 for detecting degrees of inflation of a negative-pressure bellows 30 in substitution for the pressure sensor (S3 sensor) 17.

The negative-pressure bellows 30 has a bellows configuration which is flexible in the z-axis direction and is formed of rubber material and resin material. The inside of the bellows 30 has a sealed space, and the bellows 30 is connected so as to be specially communicated with the air opening path 22 between the valve 10 and the downstream side tank 2. It is preferable for the bellows 30 to hardly have a spring constant. A spindle 31 is attached to the bottom of the bellows 30. Therefore, expansion and contraction of the bellows 30 varies the position of the spindle 31 in the z-axis direction. The upper position sensor (S4 sensor) and the lower position sensor (S5 sensor) 29 for detecting the spindle 31 of the bellows 30 are disposed at the positions corresponding to an upside and a downside of the z-axis direction in an expansion and contraction range of the bellows 30.

The arrangement positions of the S4 sensor 28 and the S5 sensor 29 are set so as to correspond to an upper limit and a lower limit of an allowed air chamber pressure range in the downstream side tank 2, namely an upper limit and a lower limit of an allowed amount of ink in the downstream side tank 2. Outputs from the two sensors 28, 29 are supplied to the control unit (not shown) to be used for controlling the duty of the pump 4.

As regards the initial state of the bellows 30, the pressure in the downstream side tank 2, and arrangement positions of the bellows 30 itself and each sensor 28, 29 are designed so that the spindle 31 is positioned between the S4 sensor 28 and the 5S sensor 29.

Figure 15A:
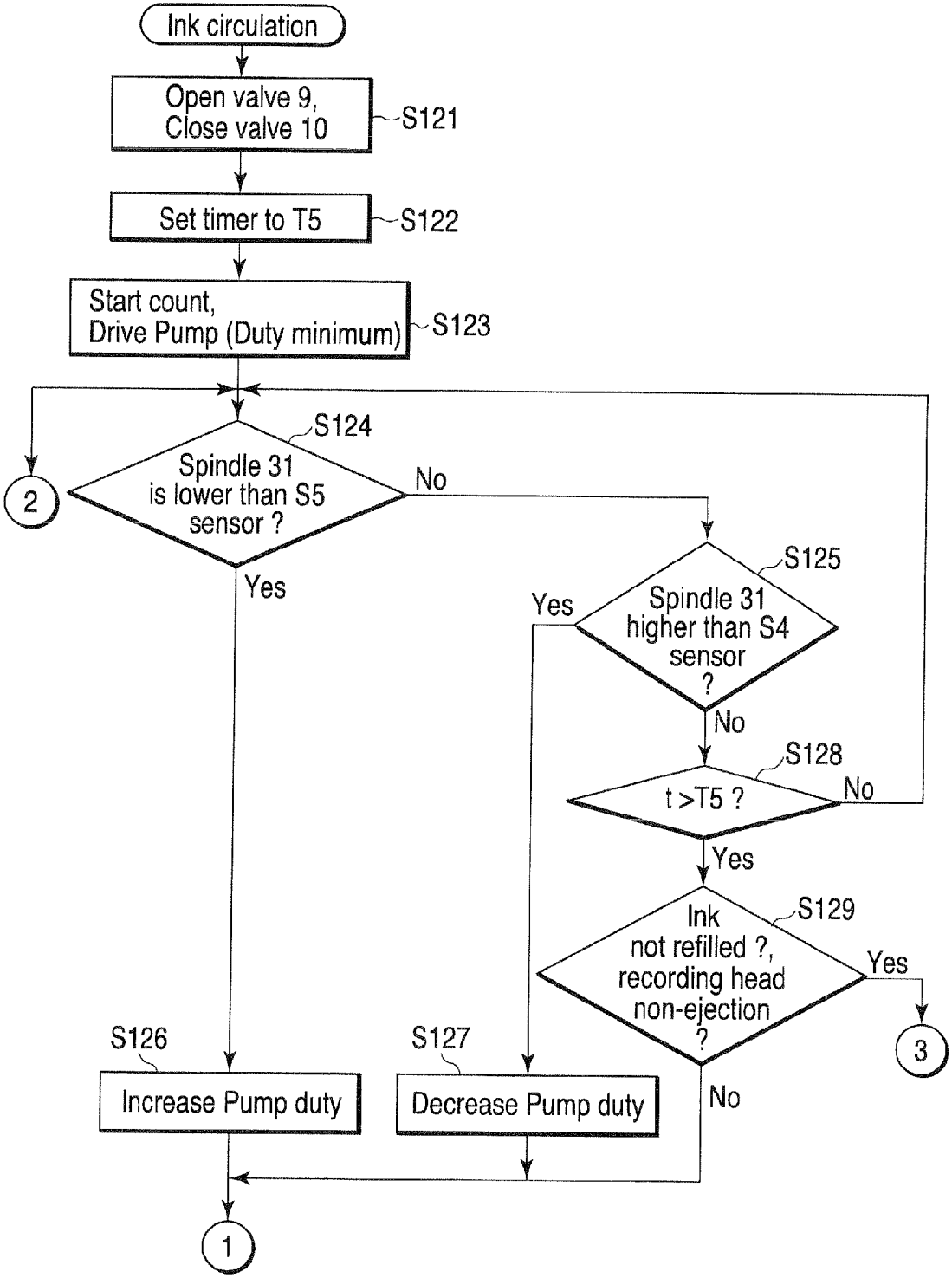
FIG. 15A is a first half part of a flowchart for explaining a method for detecting abnormality on the ink path in circulation in the third embodiment.
Figure 15B:
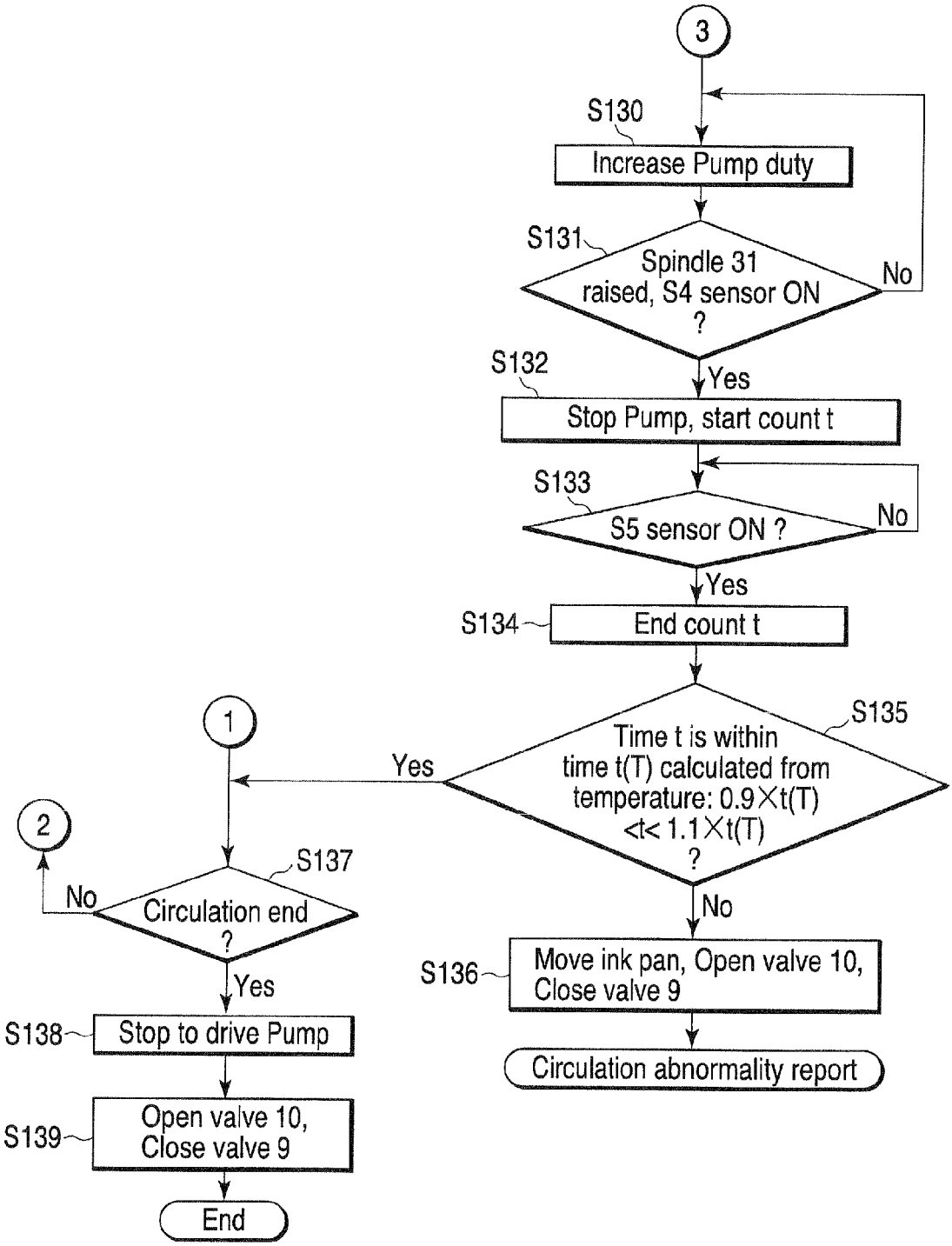
FIG. 15B is a second half of a flowchart following FIG. 15A.

A method for detecting abnormality in an ink circulation path of the third embodiment will be described with reference to flowcharts shown in FIGS. 15A and 15B.

Since the detection of the ink liquid surface, the confirmation of the ink circulation path, and the filling process of the embodiment are the same as those of the first embodiment, their explanations will be omitted.

The ink circulation operations of the embodiment are controlled by the expansion and contraction of the bellows 30, namely the height of the spindle 31. The apparatus firstly opens the valve 9 and closes the valve 10 (Step S121). After this, the apparatus sets the time T5 for the timer (Step S122). The time T5 is the time until the duty in ink circulation becomes stable, and is appropriately set in manufacturing. After the setting, the apparatus starts to drive the pump 4 with the duty minimum, and starts the count of the timer (Step S123).

The apparatus then determines whether or not the spindle 31 of the bellows 30 is detected by the S5 sensor 29 (Step S124). If the spindle 31 is detected by the S5 sensor (YES, Step S124), since the fact means that the amount of ink in the downstream side tank 2 is too much in comparison with an allowable amount of ink, the apparatus increases the duty of the pump 4 to raise the spindle 31 (Step S126). Conversely, if the spindle 31 is not detected by the S5 sensor (NO, Step S124), the apparatus determines whether or not the spindle 31 is detected by the S4 sensor 28 (Step S125). If it is determined that the spindle 31 is detected by the S4 sensor (YES, Step 125), since the fact means that the amount of ink in the downstream side tank 2 is too less in comparison with the allowable amount of ink, the apparatus decreases the duty of the pump 4 to lower the spindle 31 (Step S127).

As regards the duty to be loaded on the pump 4, the height thereof is controlled so that the spindle 31 is positioned between the S4 sensor 28 and the S5 sensor 29. If the spindle 31 is positioned within the range, the negative-pressure bellows 30 is riot extended to the maximum and is not contracted to the minimum, and the ink circulation path is brought into a state where the weight of the spindle 31 balances with the air chamber pressure of the downstream side tank 2. The weight of the spindle 31 is selected to the weight balancing with the desired negative pressure in the air chamber of the downstream side tank 2. That is, the desired negative pressure is generated in the downstream side tank 2 in accordance with the expansion and contraction of the bellows 30 caused by the spindle 31.

If both determinations in Steps S124 and S125 are NO, the spindle 31 results in being positioned between the positions detected by the S4 sensor and the S5 sensor, the duty of the pump 4 has been maintained as it is.

The apparatus then determines whether or not the time t set by the timer exceeds the set time T5 (Step S128). If the time t does not exceed the set time t5 (NO, Step S128), the apparatus returns to Step S124 to detect the position of the spindle 31, and if the time t exceeds the set time T5 (YES, Step S128), the apparatus determines whether the ink is not refilled from the bottle 1, and whether the recording head 25 is brought into a state of non-ejection of the ink (Step S129). This is because, as regards the timing of the confirmation of the ink circulation in image formation, the operation has been performed in consideration of not applying sudden pressure variations to the downstream side tank 2 and the recording head 25. That is, in a case in which the ink has been refilled from the bottle 1, it is impossible to detect whether the ink circulation is in a normal state, and if the confirmation of the ink circulation is performed in image formation (during ejection of the ink from the recording head 25), the sudden change in pressure is applied to the recording head 25, the quality of the image formation may be decreased.

If each condition is not satisfied in the determination (NO, Step S129), the apparatus returns to Step 124. If each condition is satisfied in the determination (YES, Step S129), the apparatus purposefully increases the duty of the pump 4 (Step S130). As a result, the bellows 30 contracts to raise the spindle 31. The process increasing the duty of the pump 4 is continued until the spindle 31 is detected by the S4 sensor 28 (Step S131). If the spindle 31 is raised up to the position detected by the S4 sensor, the spindle 31 is detected by the S4 sensor 28 and the S4 sensor is turned on (YES, Step S131). If the S4 sensor 28 is turned on, the apparatus temporarily stops to drive the pump 4 and starts to count the timer count t by the timer (Step S132).

Since the recording head 25 continuously lets the ink flow toward the downstream side tank 2, but the downstream side pump 4 does not let the ink flow because of the stoppage of the drive of the pump 4, the ink liquid surface in the downstream side tank 2 is raised. Since the rising the ink liquid surface supplies the air in the air chamber to the bellows 30 to expand the bellows 30, and since the own weight of the spindle 31 expands the bellows 30, the height of the spindle 31 begins to lower.

If the S5 sensor 29 detects the lowering of the spindle 31 (Step S133), the apparatus terminates the count of the timer (Step S134). At this time, the rate of the lowering of the spindle 31 depends on a flow amount of ink to be supplied into the downstream side tank 2 from the upstream side tank 3 through the recording head 25. As mentioned above, the flow amount of ink depends on the ink viscosity, namely the ink temperature.

The temperature sensor 26 then detects a ink temperature T and the apparatus compares a lowering time t(T) from the position of the S4 sensor 28 to the position of the S5 sensor 29 on the basis of the flow amount of ink calculated from the ink temperature T with the actually measured time t under a comparison condition of $[0.9\times t(T)<t<1.1\times t(T)]$ (Step S135). The appropriate lowering time t(T) for the ink temperature is expressed in a table form in advance, and is stored in a state which is readable to the control unit (not shown). In this comparison, if the measured time t is within ±10% of the appropriate lowering time t(T) calculated from the ink temperature T (YES, Step S135), it is determined that the ink circulation path (the supply flow path 20, recording head 25, return flow path 21) is not abnormal, and the apparatus shifts to Step S137 described later. Conversely, if the measured time t is out of the range (No, Step S135), it is determined that the ink circulation path is abnormal, and the apparatus moves the ink pan below the recording head 25, closes the valve 9, and opens the valve 10 (Step S136). The apparatus then reports that the ink circulation path is abnormal and the ink circulation has riot been performed correctly to stop the pump 4.

If the apparatus terminates the ink circulation (YES, Step S137), the apparatus stops to drive the pump 4 (Step S138) (however, if the Step S124 determines No, the pump 4 has already been stopped to be driven in Step S132), closes the valve 9, opens the valve 10 (Step S139), and terminates the confirmation operations of the ink circulation (ink circulation path).

According to the embodiment, the arrangement of the bellows 30, which varies its volume, for the communication with the air chamber in the downstream side tank 2 enables continuing the ink circulation while avoiding the change in pressure to be supplied to the nozzle 25*d*, even when the pump 4 is temporarily stopped.

Further, detecting the position of the spindle 31 of the bellows 30 enables detecting the flowing of the ink from the upstream side tank 3 to the downstream side tank 2. Moreover, measuring the time of the change in height of the bellows 30 due to the ink temperature enables further accurately detecting the abnormality in the ink circulation path.

In this embodiment, the apparatus temporarily stops the pump 4 in ink circulation, and determines whether or not the ink flows normally by detecting the change in position of the bellows 30 and the spindle 31 attached thereto, and the time length of the change. Of course, the invention is not limited to this method for determining, the apparatus detects the presence or absence of the change in height of the liquid surface by means of the S1 sensor 15 or the S2 sensor 16, and the time until sensor output logic is changed (change in on/off), and may determine whether or not the ink has been flowed normally in comparison with the normal state of the ink circulation. In this case, it is needed that the position of the bellows 30 is within the range of the change in ink volume in the logical change of the S1 sensor 15 or the S2 sensor 16, and the position of the bellows 30 is at least within the range in which the bellows 30 can be expanded and contracted. Therefore, it is preferable for the bottom of the bellows 30 (spindle 31) to be positioned between the S4 sensor 28 and the S5 sensor 29.

Figure 14:
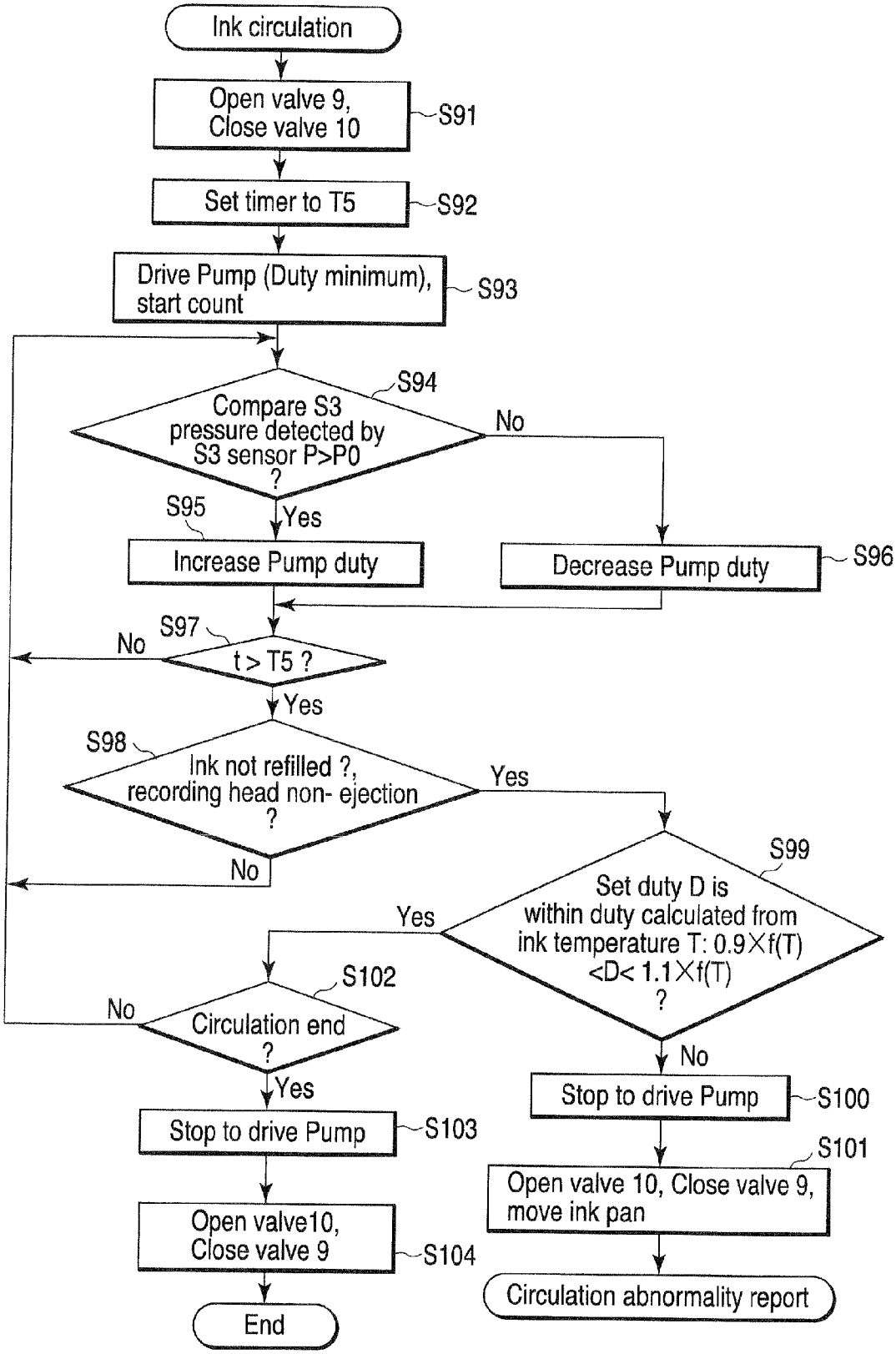
FIG. 14 is an exemplary flowchart for explaining ink circulation in which the ink flows in image formation in the second embodiment.

Further, as regards another determination method, the apparatus may determine whether or not the duty is appropriate to the ink temperature at that time in accordance with the method described in FIG. 14 of the first embodiment on the basis of the duty of the pump 4 in a case in which the height of the bellows 30 is controlled to be between the S4 sensor 28 and the S5 sensor 29.

Moreover, according to the embodiment, the apparatus may generate the desired negative pressure in the downstream side tank 2 in accordance with a simple configuration using the bellows 30 in addition to effects of the foregoing first embodiment.

The following will describe a fourth embodiment.

Figure 3:
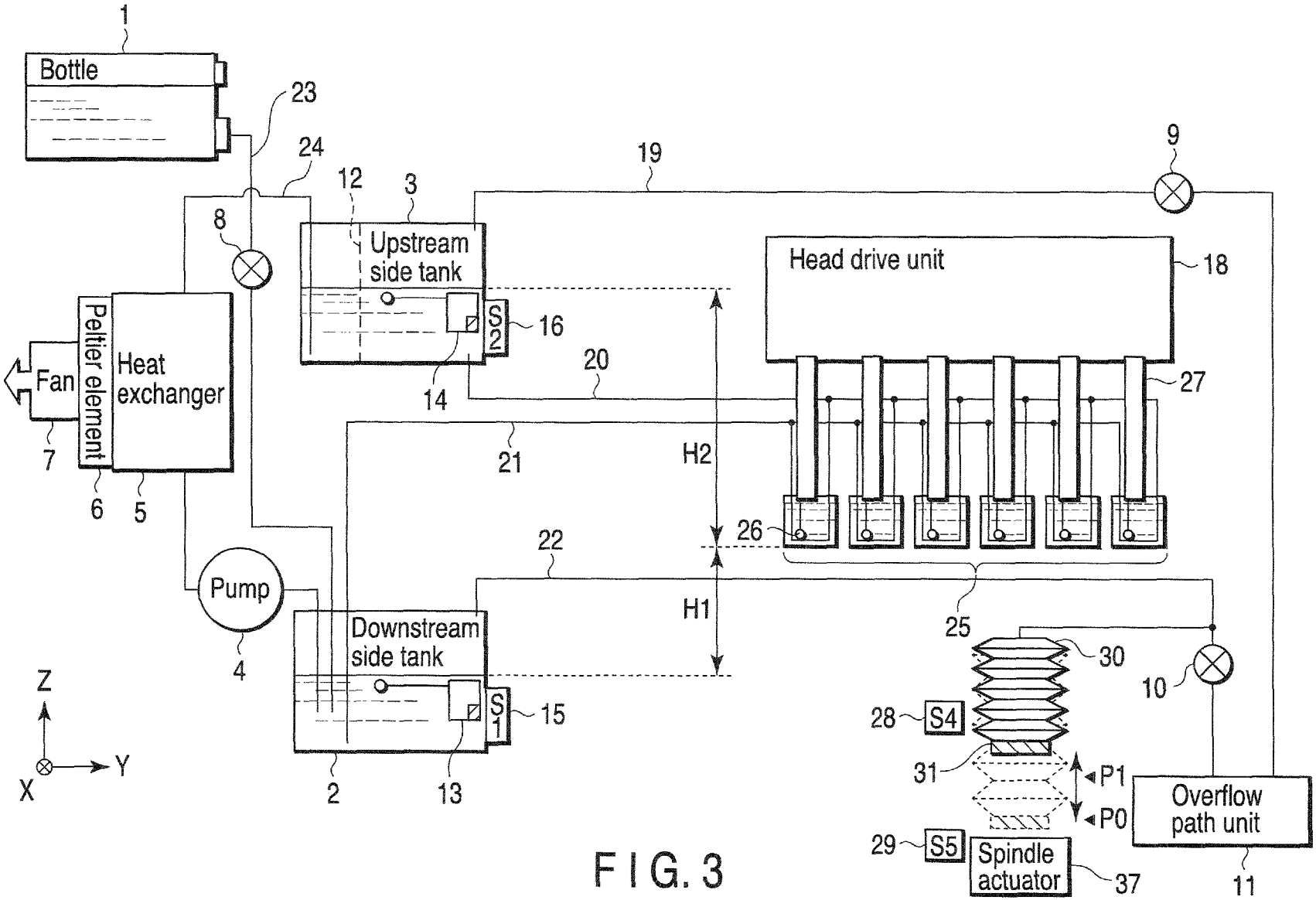
FIG. 3 is an exemplary view depicting a configuration example concerned with the ink circulation path of the image forming apparatus for achieving the method for confirming the ink circulation path and the method for filling with the ink as a fourth embodiments of the invention.

FIG. 3 shows a configuration example related to an ink circulation path of an inkjet printer for achieving a method for confirming ink circulation path and a method for filling with ink as a third embodiment of the invention. Also in FIG. 3, similarly to the third embodiment, it is assumed that the ink circulation path has constituent units which have been provided for a usual image forming apparatus. In the constituent units of the fourth embodiment, the units equivalent to the constituents of the third embodiment are designated by the identical reference symbols and explanations thereof are omitted.

In addition to the configuration of the foregoing third embodiment, a liquid surface adjuster 32 is disposed at a suction port of the flow path 24 which takes in the ink from the downstream side tank 2 to the pump 4.

Figure 12A:
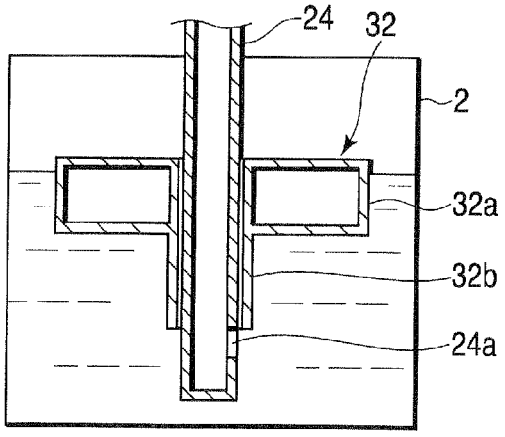
FIGS. 12A and 12B are exemplary views depicting an operation of a liquid surface adjuster to be used for a downstream side tank in the third embodiment.
Figure 12B:
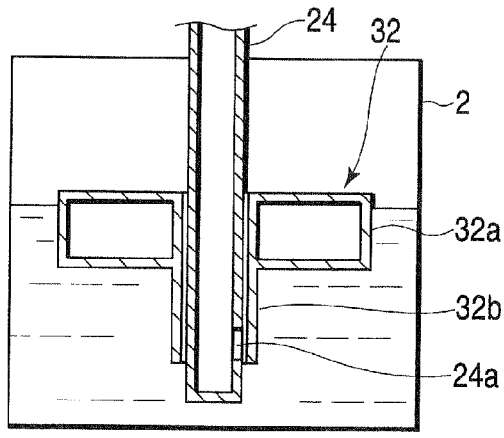

The adjuster 32 is engaged into the flow path 24 composed of a pipe, as shown in FIGS. 12A and 12B, and is provided in a vertically movable manner along with a flow path peripheral side surface as a guide. The adjuster 32 is composed of a float unit 32*a* with a ring shape in which a gas (e.g., air) is sealed at an upper part, and a projection 32*b* with a cylinder at a lower part. The flow path 24 is extended up to the position close to the bottom in the downstream side tank 2. An ink intake port 24*a* for sucking the ink is opened on the lower part outer circumference surface of the flow path 24.

FIG. 12A shows a state in which an appropriate amount of ink is filled in the downstream side tank 2 and the liquid surface is heightened, and FIG. 12B shows a state in which the liquid surface is lowered. When the liquid surface is high, since the intake port 24*a* is exposed from the adjuster 32, the pump 4 may suck the ink. Meanwhile, since the adjuster 32 is lowered as the liquid surface becomes low due to the suction of the ink and the intake port 24*a* is blocked by the projection 32*b*, the pump 4 becomes impossible to suck the ink. The suction ability of the pump 4 is designed so as to always exceed an amount of ink to be returned from the recording head 25 to the downstream side tank 2. In this embodiment, since the height of the liquid surface of the ink varies a suction amount of ink by the pump 4, it is not needed for the pump 4 itself to control its duty, and it is enough only to be continuously driven. Especially, since the slight and vertical movement of the height of the adjuster 32 enables adjusting the suction amount, the liquid surface in the downstream side tank 2 may be maintained at almost the same height.

In this embodiment, since the adjuster 32 is installed, if the liquid surface of the ink in the downstream side tank 2 is lowered, and if the intake port 24*a* is blocked with the adjuster 32, the pump 4 cannot generate the negative pressure in the air chamber inside the downstream side tank 2. Therefore, the spindle 31 is provided for the bellows 30, the own weight of the spindle 31 expands and contracts the bellows 30, and then, the downstream side tank 2 generates the negative pressure. A spindle actuator 37 may move in the z-axis direction, expands the bellows 30 by the own weight of the spindle 31 in lowering, and pushes up the spindle 31 to contract the bellows 30 in rising. The uppermost position of a movement range of the actuator 37 is a position at which the spindle 31 to be pushed up is positioned to the position detected by the S4 sensor 28, and the lowermost position thereof is a position at which the spindle 31 is positioned to the position detected by the S5 sensor 29. In a state in which the bellows 30 is contracted with the maximum extent, the spindle 31 is positioned at the position detected by the S4 sensor 28, and in a state in which the bellows 30 is expanded with the maximum extent, the spindle 31 is positioned at the position which is lower than the position detected by the S5 sensor 29 (however, in accordance with the setting of the lowermost position of the actuator 37, the lowermost position of the spindle 31 is set to the position detected by the S5 sensor 29). The home position HP of the actuator 37 is set to the aforementioned uppermost position. When the actuator 37 is lowered to the lowermost position in a state in which the valve 9 is opened and the valve 10 is closed, the bellows 30 expands downward with the own weight of the spindle 31, the air chamber of the downstream side tank 2 generates the negative pressure therein. It is assumed that the lowering rate of the spindle actuator 37 is faster than the expansion rate of the negative-pressure bellows 30, namely the lowering rate of the spindle 31. The negative pressure and the head pressure difference from the upstream side tank 3 pose a pressure difference about 6 kPa, the pressure difference lets the ink flow to the downstream side tank 2 by passing through the recording head 25.

When the apparatus drives the pump 4 in such a state, since the pump 4 pumps up the amount of ink larger than the amount of ink to be flowed from the recording head 25, the bellows 30 contracts as the liquid surface of the ink in the downstream side tank 2 lowers. The position of the adjuster 32 gradually lowers with the lowering of the liquid surface of the ink, it results in blocking of the intake port 24*a*, and the pump 4 may not pump up the ink. Thus, the liquid surface in the downstream side tank 2 maintains a constant height in accordance with the operations of the adjuster 32. Since the fact that the height of the liquid surface is maintained almost constant makes the pressure in the air chamber of the downstream side tank 2 almost constant, the height and position of the spindle 31 of the bellows 30 becomes approximately constant. The position of the spindle 31 at this moment is set to a prescribed height and position P1 between the positions detected by the S4 sensor 28 and the S5 sensor 29.

Figure 16A:
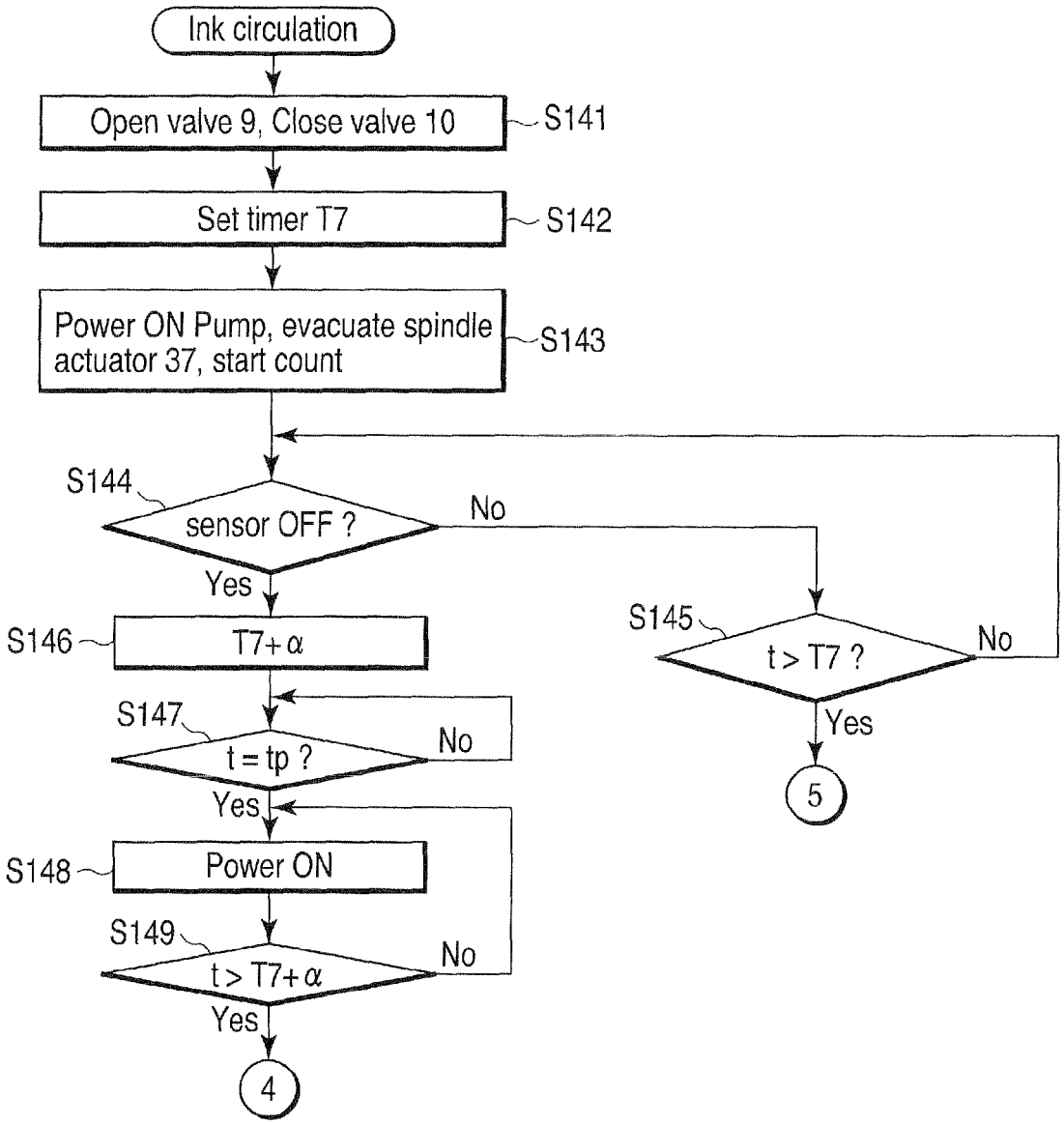
FIG. 16A is a first half of a flowchart for explaining a method for determining whether or not the flow of ink in circulation operation is normal in the fourth embodiment.
Figure 16B:
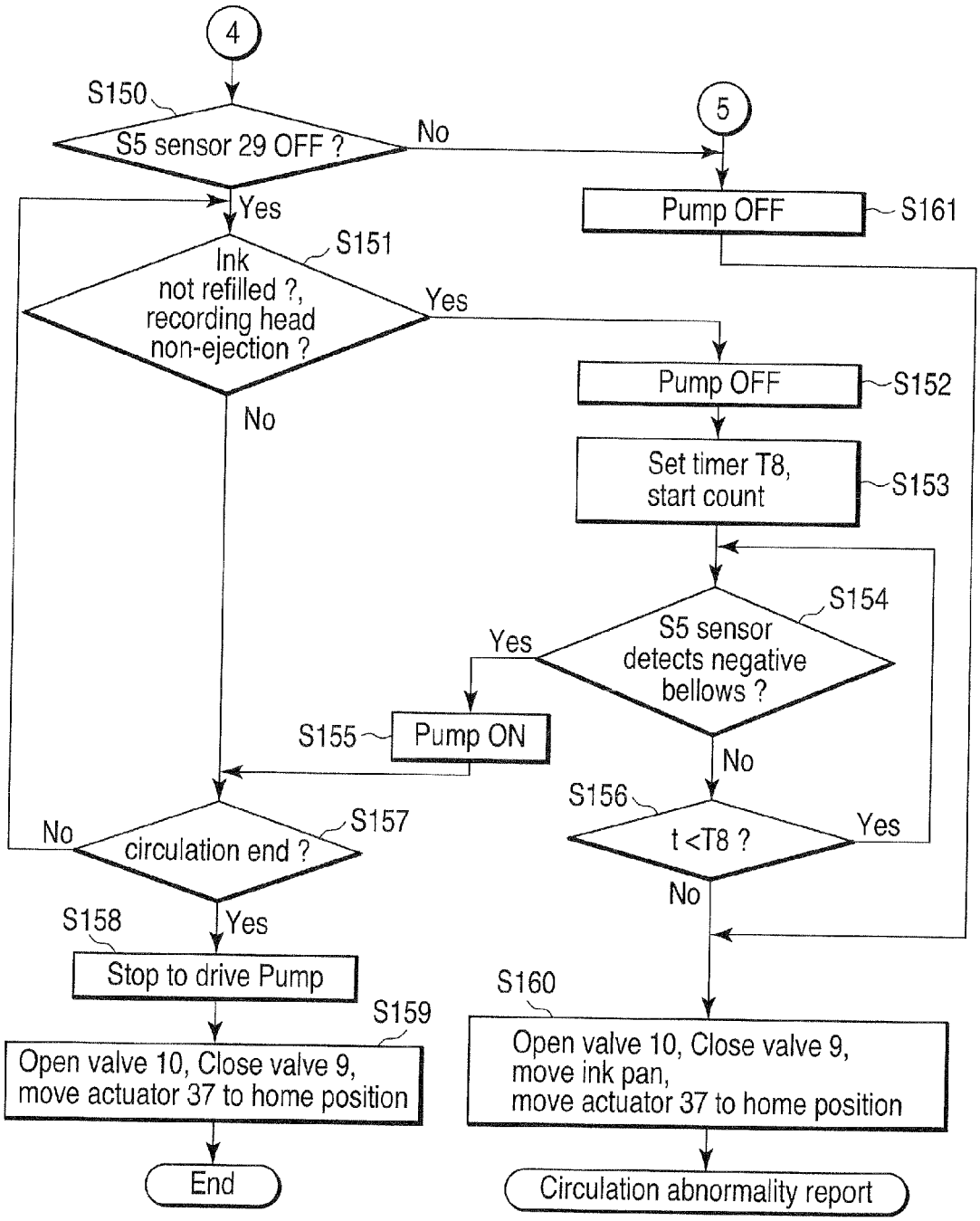
FIG. 16B is a second half of a flowchart following FIG. 17A.

A method for determining whether or not a flow of ink during ink circulation operation is normal will be described by referring to FIGS. 16A and 16B.

In an initial state, the valve 9 is closed, the valve 10 is opened, and the spindle actuator 37 is positioned at the home position HP. Since the valve 10 is opened, even when the bellows 30 is contracted, the positive pressure is not generated in the downstream side tank 2. At this moment, the apparatus is in a state in which the S4 sensor 28 has detected the spindle 31 of the bellows 30.

In this state, the apparatus firstly opens the valve 9 and closes the valve 10 (Step S141). The timer is set to a prescribed time T7 (Step S142). The time T7 is a time required to move the spindle 31 of the bellows 30 from the position which has been detected by the S4 sensor 28 to the position which has not been detected thereby, and a time for determining that the ink circulation is abnormal if the S4 sensor sill detects the spindle 31 after the lapse of the prescribed time T7. After this, the apparatus evacuates the actuator 37 to the lowermost position, and starts to count the timer (Step S143). Evacuating the actuator 37 gradually expands the bellows with the own weight of the spindle 31 and the lowers the height and position of the spindle. Since the downstream side tank 2 generates the negative pressure, the ink flows from the recording head 25 to the downstream side tank 2, and the liquid surface of the ink rises.

Next, the spindle 31 provided for the bottom of the bellows 30 moves from the position detected by the S4 sensor 28 to determine whether or not the spindle 31 moves to a position which is impossible to be detected (Step S144). If the apparatus is in a state in which the ink flows normally to the downstream side tank 2, the bellows 30 expands by the volume almost equal to the amount of ink flowing into the downstream side tank 2, thereby the spindle 31 lowers, and the spindle 31 deviates from the position detected by the S4 sensor 28 before the count time t by the timer reaches the prescribed time T7. If the S4 sensor 28 has continued to detect the spindle 31 in this determination (NO, Step S145), the apparatus determines whether or not the count time t by the timer exceeds the time T7 (Step S145). If the time t has not exceeded the time t7 (NO, step S145), the apparatus continues to monitor the output detected by the S4 sensor 28. Conversely, if the time t has exceeded the time T7 (YES, Step S145), the apparatus determines that the ink does not flow into the downstream side tank 2 to stop driving the pump 4 (Step S161), after moving the ink pan downside of the recording head 25, closes the valve 9, opens the valve 10 (Step S147), and reports an error to the user to stop the pump 4. Even when the pump 4 has already stopped, the apparatus executes drive stop processing at least.

If it is determined that the S4 sensor 28 turns off and the spindle 31 of the bellows 30 has normally lowered (YES, Step S144), a time a is added to the prescribed time T7 (Step S146) then it is determined whether or not the count time t by the counter reaches the time tp (Step S147). Here, the time a is a time which is necessary for the spindle 31 to reach the position detected by the S5 sensor 29 after the spindle 31 has deviated from the position detected by the S4 sensor 28 because the bellows 30 has expanded due to the evacuation of the actuator 37 in a state in which the pump 4 has not been driven. The time tp is a time which is necessary for the spindle 31 to reach the prescribed position P0 (set lower than P1) between the S4 sensor 28 and the S5 sensor 29 from the position of the spindle 31 in a state in which the actuator 37 is at the home position HP as the bellows 30 has expanded by the own weight.

If the count time t reaches the set time tp (YES, Step S147), the pump 4 is driven (Step S148). The duty of the pump 4 differs from the duty minimum in the foregoing embodiment, and is set to an extent in which the pump 4 may pump up the amount of ink larger than the amount of ink to flow into the downstream side tank 2. If the ink circulation path is normal, the liquid surface of the ink in the downstream side tank 2 is lowered by the drive of the pump 4, the bellows 30 which has been expanding till then shifts to begin its contraction. Continuation of the liquid surface of the ink disables the pump up of the ink by means of the pump 4 at the time when the intake port 24*a* is blocked due to the operation of the adjuster 32, and makes the liquid surface of the ink approximately constant. Therefore, if the state of the ink circulation path is normal, the contraction of the bellows 30 stops at the position at which the liquid surface of the ink is maintained constant, the height and position of the spindle 31 is maintained at the height and position on the P1 (higher than the P0).

The apparatus then determines whether a set time (T7+α) has passed (Step S149), if the time (T7+α) has passed (YES, Step S149), the apparatus determines whether or not the spindle 31 is detected by the S5 sensor 29 (Step S150). If any abnormality occurs in the ink circulation path, for example, if air, but not the ink, has gotten in the downstream side tank 2, although the liquid surface of the ink in the downstream side tank 2 has been maintained constant, the bellows keeps its expansion due to the getting in of the air inside the bellows, and the spindle 31 is detected by the S5 sensor around the time when the count time t of the timer exceeds the time (T7+α).

If it is determined that the S5 sensor 29 has detected the spindle 31 (NO, in Step S150), the apparatus shifts to Step S161, after stops to drive the pump 4, moves the ink pan on the lower side of the recording head 25, closes the valve 9, opens the valve 10, and after moving the actuator 37 to the home position HP (Step S160), performs processing at the time of an occurrence of abnormality for reporting the error to the user. Conversely, if the S5 sensor 29 has not detected the spindle 31 (YES, Step S150), the expansion of the bellows 30 stops, it is determined that the spindle 31 has sopped at the position of P1, and the apparatus shifts to Step S151.

The apparatus determines whether the ink has not been refilled from the bottle 1, and whether the recording head 25 has been in a state of non-ejection of the ink (Step S151) if it is determined that the apparatus is at the timing when the ink is not refilled, and the ink is not ejected (YES, Step S151), the apparatus stops to drive the pump 4 (Step S152). At the same time of the stoppage of the pump 4, a set time T8 is set to the timer, and a count is immediately started (Step S153). The set time T8 is a time necessary for the spindle 31 to move from the position of P1 to the position detected by the S5 sensor 29, and a set time which is set in advance. When the stoppage of the drive of the pump 4 makes the ink passing through the recording head 25 flow into the downstream side tank 2, since the liquid surface of the downstream side tank 2 rises, and the air in the air chamber flows into the bellows 30, the bellows expands downward.

The apparatus subsequently determines whether or not the spindle 31 of the bellows 30 has been detected by the S5 sensor (Step S154). If the spindle 31 has been detected by the S5 sensor 29 within the set time T8 (YES, Step 154), the apparatus determines that the ink flows normally, and drives the pump 4 again (Step S155). Conversely, if the spindle has not been detected by the S5 sensor 29 within the set time T8 (NO, Step S154), the apparatus continues the detection until the count time t exceeds the set time T8 (Step S156). If the spindle 31 has not been detected even the count time t exceeds the set time T8 (NO, Step S156), the apparatus determines the occurrence of any abnormality in the ink circulation, and shifts to Step 160 to perform for the abnormality. That is, the apparatus moves the ink pan to the lower side of the recording head 25, closes the valve 9, opens the valve 10, and after moving the actuator 37 to the home position HP, reports the error to the user.

Conversely, it is determined that the apparatus is at the timing when the ink is refilled and the ink is ejected (NO, Step S151), the apparatus determines whether an command to terminate the circulation has issued (Step S157), and if the apparatus determines the issue of the command (YES, Step 157), the apparatus stops to drive the pump 4 (Step S158). After stopping the drive of the pump 4, the apparatus moves the ink pan on the lower side of the recording head 25, closes the valve 9, opens the valve 10, and after moving the actuator 37 to the home position HP, terminates the operations (Step S159).

As mentioned above, the embodiment may determine whether the ink circulation path 20, 21 are normal or abnormal by determining whether or not the position of the spindle 31 of the bellows, which has naturally expanded by the own weight from the position of the bellows 31 (position detected by the S4 sensor 28) where the actuator 37 is positioned at the home position HP, has deviated within the prescribed time period from the position detected by the S4 sensor 28. In a state of drive of the pump 4, determining whether the bellows 30 has expanded by means of the S5 sensor 29 enables determining whether the ink circulation paths 20, 21 are normal or abnormal.

Determining whether the position of the spindle 31 when the bellows 30 has naturally expanded by the own weight of the spindle 31 from the position P1 of the spindle 31 corresponding to the liquid surface of the ink in a case in which the intake port 24*a* is blocked by the adjuster 32 by the S5 sensor 29 within the prescribed time T8 enables determining whether or not the ink circulation is in the normal state.

The apparatus may detect that the ink flows to the downstream side tank 2 through the recording head 25 by controlling on/off of the drive of the pump 4, since the bellows 30 varies its inner volume, and the spindle 31 keeps the pressure in the air chamber constant while appropriately maintaining the pressure from the nozzle 25*d* by controlling on/off of the drive of the pump 4, although the liquid surface of the downstream side tank 2 varies.

The aforementioned first to fourth embodiments have been described example in which the timing to determine whether or not the ink circulation is in the normal state is not the timing of ink refilling, but the timing at which the recording head 25 does not eject the ink. This is because the performing at the timing with less pressure variation of the downstream side tank 2 easily enables determining further accurately; however the invention is not limited to such timing.

The following will explain a fifth embodiment.

Figure 4:
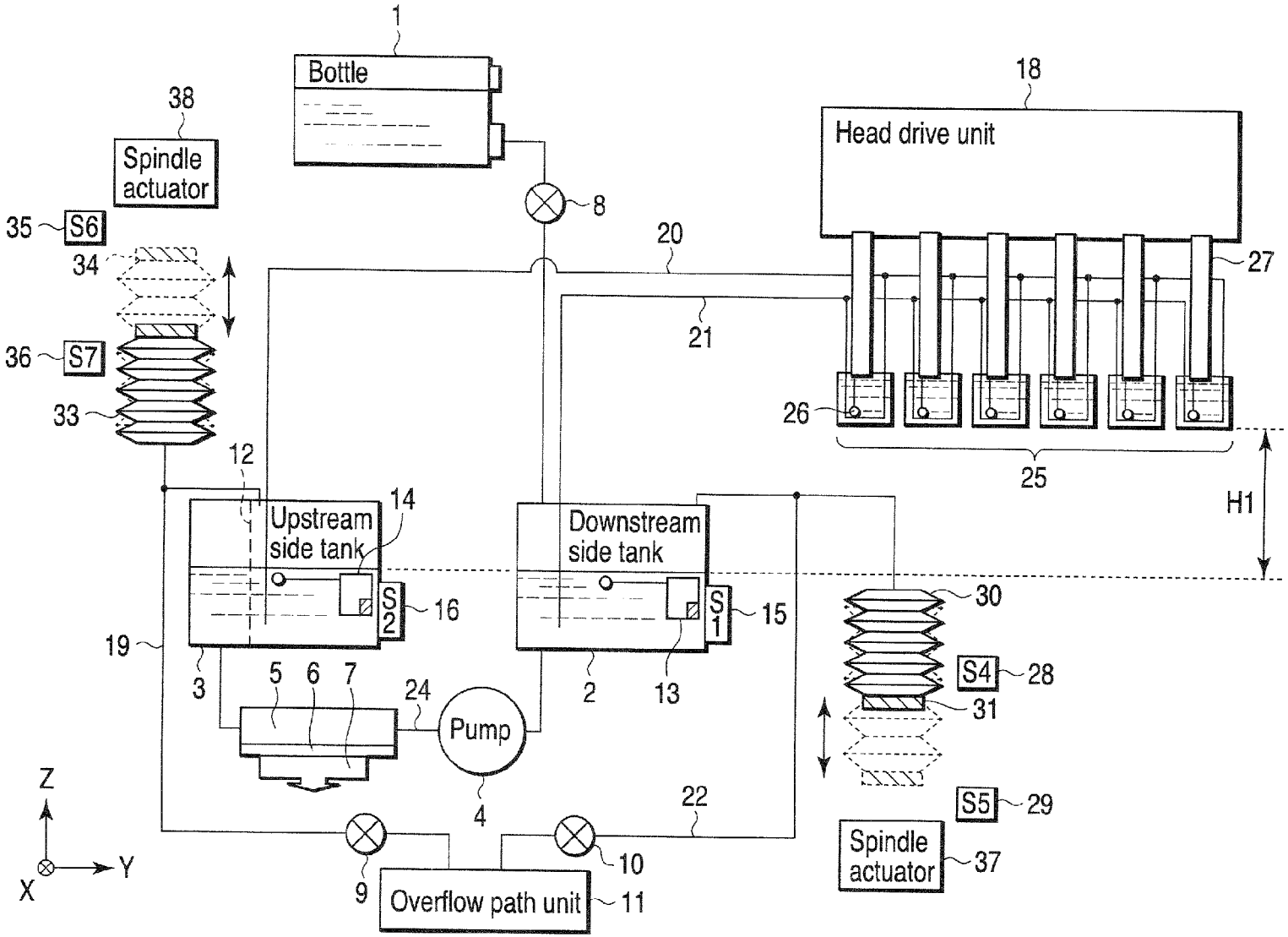
FIG. 4 is an exemplary view depicting a configuration example concerned with the ink circulation path of the image forming apparatus for achieving the method for confirming the ink circulation path and the method for filling with the ink as a fifth embodiment of the invention.

FIG. 4 shows a configuration example related to ink circulation paths of an image forming apparatus for achieving a method for confirming ink circulation path and a method for filling with ink. It is assumed that the ink circulation paths each have constituent units which have been provided for a usual image forming apparatus. In the constituent units of the fifth embodiment shown in FIG. 4, the units equivalent to the constituents of the fourth embodiment are designated by the identical reference symbols and explanations thereof are omitted.

While the aforementioned fourth embodiment has made a difference in height between the liquid surfaces of the downstream side tank 2 and the upstream side tank 3 and arranged them, in this embodiment, the height of the downstream side tank 2 and the upstream side tank 3 are the same from each other, both the tanks 2, 3 are arranged by a lower side by E1 from the height of the nozzle plate 25*c*. The liquid surface adjuster 32 disposed in the fourth embodiment is not disposed in this fifth embodiment. The fifth embodiment differs from the fourth embodiment in terms of disposing a pressure bellows for the upstream side tank 3.

In the configuration of the embodiment, the configuration of the downstream side tank 2 is equivalent to that of the fourth embodiment (FIG. 3). Since the upstream side tank 3 is arranged on the lower side of the nozzle plate 25*c*, the tank 3 cannot generate positive pressure caused by head pressure to the recording head 25. Therefore, a pressure bellows 33 is disposed on the air opening path 19 of which one end is connected to the air chamber of the upstream side tank 3. The uppermost part of the bellows 33 is provided with a spindle 34, pushing the bellows 33 from an upside thereof by the own weight (the gravity) contracts the bellows 33 and enables applying the positive pressure to the air chamber of the upstream side tank 3.

The other end of the air opening path 19 communicates with the overflow path unit 11 through the valve 9. The valve 9 has a normally open type in the same way as that of the valve 10.

To detect the height of the spindle 34 attached to the upper part of the pressure bellows 33, a position sensor (S6 sensor) 35 and a position sensor (S7 sensor) 36 are disposed. The S6 sensor 35 detects the spindle 34 when the bellows 33 expands up to a maximum, and the S7 sensor 36 detects the spindle 34 when the bellows 33 contracts up to a minimum.

A spindle actuator 38 is disposed in order to expand and contract the bellows 33. This actuator 38 is an actuator in order to pull up the spindle 34 and to pull away the pulled up spindle 34, and is set a position (a position at which the spindle 34 is detected by the S6 sensor 35) at which the spindle 34 is pulled up to a maximum top part as a home position HP.

Figure 17A:
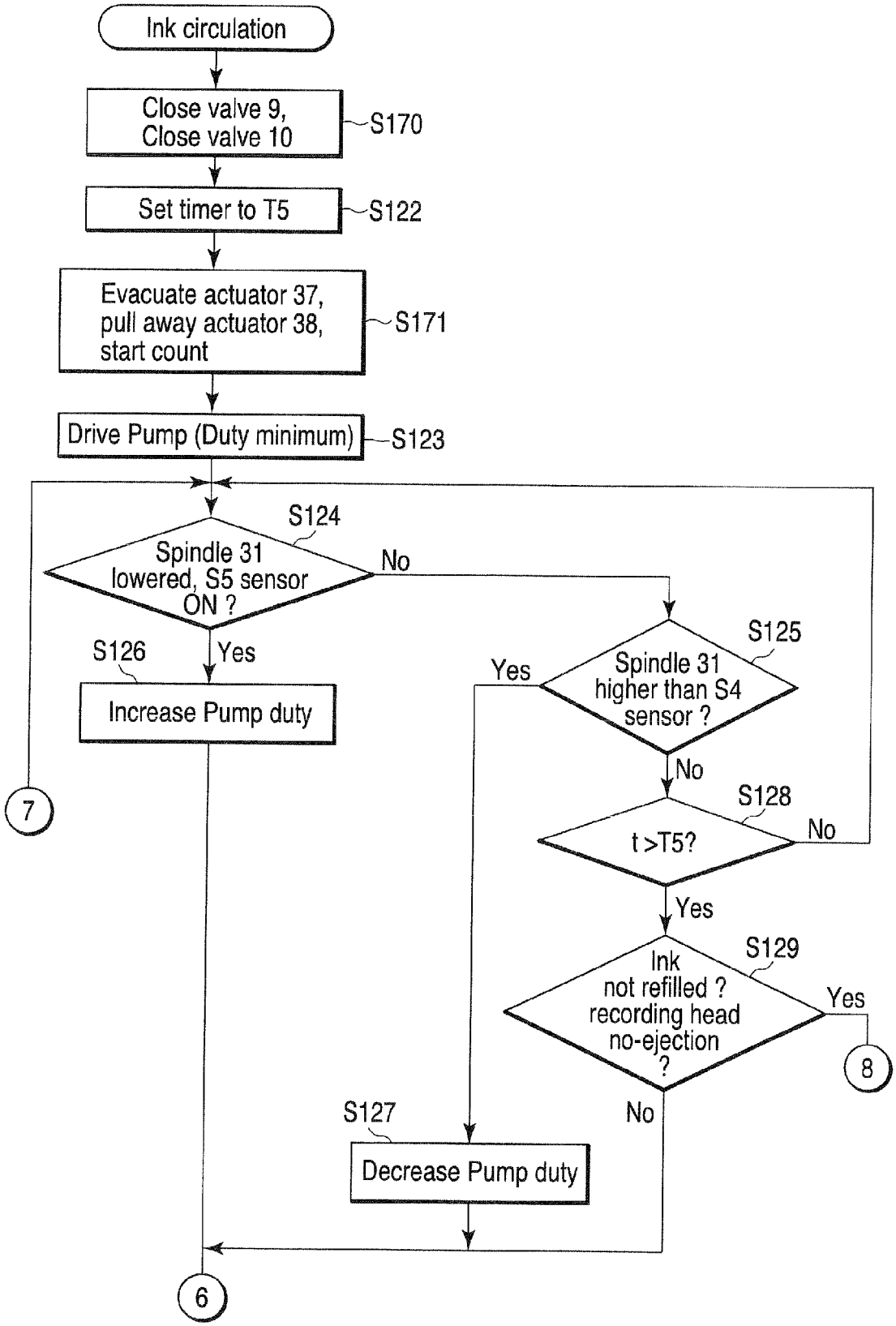
FIG. 17A is a first half of a flowchart for explaining a method for determining whether or not the flow of ink in circulation operation is normal in the fifth embodiment.
Figure 17B:
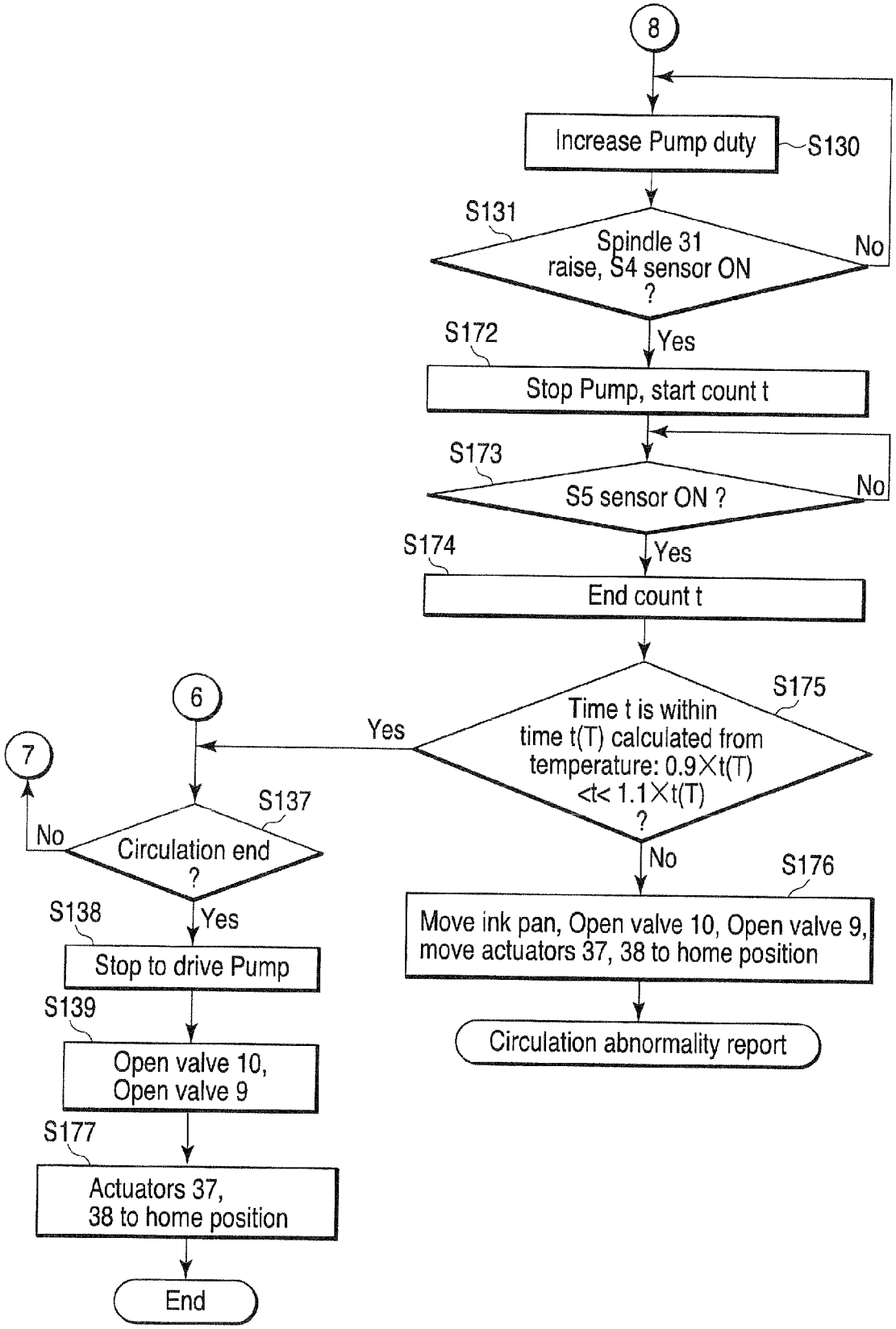
FIG. 17B is a second half of a flowchart following FIG. 17A.

A method for determining whether or not a flow of ink in circulation operation is normal will be described by referring to flowcharts shown in FIGS. 17A and 17B. The same step as that of the ink circulation method (refer to FIGS. 15A and 15B) described in the third embodiment is designated by the identical reference symbols.

As regards an initial state, the actuators 37, 38 are each set at the home positions. That is, the spindle 31 is set at a position detected by the S4 sensor 28, and the spindle 34 is set at a position detected by the S6 sensor 35. The valves 9, 10 each are in open states.

From this initial state, the ink circulation operation of the embodiment closes each valves 9, 10 (Step S170). After this, the operation sets a time T5 to the timer (Step S122). The time T5 is a time until the duty in ink circulation, and is appropriately set in manufacturing.

After this, the actuator 37 evacuates on the lower side from the home position, the actuator 38 pulls away the spindle 34, and then, the operation starts to count the timer (Step S171). When the actuator 38 pulls away the spindle 34, the spindle 34 presses the bellows 33 from above by the own weight to contract the bellows 33. The expansion of the negative-pressure bellows 30 and the contraction of the pressure bellows 33 applies the negative pressure to the downstream side tank 2 and the positive pressure to the upstream side tank 3, the ink from the upstream side tank 3 flows into the downstream side tank 2 through the supply flow path 20, recording head 25 and return flow path 21.

After this, the operation starts to drive the pump 4 with the duty minimum (Step S123).

The operation then determines whether or not the spindle 31 of the bellow 30 has detected by the S5 sensor 29 (Step S124). Here, if the spindle 31 has detected by the S5 sensor 29 (YES, Step S124), since the fact means that the amount of ink in the downstream side tank 1 is too much in comparison with the allowable amount, the operation increases the duty of the pump 4 to raise the spindle 31 (Step S126). Conversely, if the spindle 31 has not been detected by the S5 sensor 29 (NO, Step S124), the operation determines whether or not the spindle 31 has been detected by the S4 sensor 28 (Step S125). If it is determined that the spindle 31 has detected by the S4 sensor 28 (Yes, Step S125), the fact means that the amount of ink in the downstream side tank 2 is too less in comparison with the allowable amount, the operation decreases the duty of the pump 4 to lower the spindle 31 (Step S127).

The duty loaded on the pump 4 is controlled so that the height of the spindle 31 is positioned between the S4 sensor and the S5 sensor 29. If the spindle 31 is positioned in this range, the bellows 30 does not expand up to a maximum, the weight of the spindle 31 matches to the air chamber pressure of the downstream side tank 2. The weight of the spindle 31 is selected to the weight matching to the desired negative pressure in the air chamber of the downstream side tank 2. That is, the expansion of the bellows by the spindle 31 generates the desired negative pressure from the downstream side tank 2.

The pressure bellows 33 expands and contracts in response to the duty of the pump 4. That is, if the duty of the pump 4 is light and the pump-up amount of ink is smaller, the own weight of the spindle 34 contracts the bellows 33. Conversely, if the duty of the pump 4 is heavy, the pump-up amount of ink is large, the air chamber pressure of the upstream side tank 3 increases, and the bellows 33 expands against the own weight of the spindle 34. The expansion and contraction of the bellows 33 keep the air chamber pressure in the upstream side tank 3 constant. If the determinations are NO in Steps S124 and S125, the spindle 31 is positioned between the positions detected by the S4 sensor 28 and the S5 sensor 29, and the duty of the pump 4 maintains as it is.

The operation determines whether or not the time t counted by the timer exceeds the set time T5 (Step S128), if the time t has not exceeded the time T5 (NO, Step S128), the operation returns to Step S124 to detect the position of the spindle 31. If the time t has exceeded the time T (YES, Step S128), the operation determines whether the ink has not been refilled from the bottle 1, and whether the recording head 25 has been in the state of non-ejection of the ink (Step S129). This is because the operation has been performed in consideration of not applying sudden pressure variations to the downstream side tank 2 and the recording head 25 as timing of confirmation the ink circulation in image formation (in a case of refilling the ink from the bottle 1, it is impossible to detect whether the ink circulation is normal or not, and if the confirmation of the ink circulation is performed in image formation [during ejection of the ink from the recording head 25], the sudden pressure variations may be applied to the recording head 25 to decrease quality of the image formation). If the operation determines that each condition is not satisfied (NO, Step S129), the operation returns to Step S138.

If it is determined that each condition is satisfied (YES, in Step S129), the operation purposefully increase the duty of the pump 4 (Step S130). As a result, the amount of ink in the downstream side tank 2 decreases, the bellows 30 contracts, and the spindle 31 rises. The processing to increase the duty of the pump 4 is continued until the S4 sensor 28 detects the spindle 31 (Step S131). When the spindle 31 rises to the position detected by the S4 sensor 28, the S4 sensor 28 detects the spindle 31 to be powered on (YES, Step S131). When the S4 sensor 28 is powered on, the operation temporarily stops to drive the pump 4 and starts to count by the timer (Step 172). It is assumed that the count of the timer is started, as matter of course, after resetting the count time t which has been counted until just a while ago.

While the recording head 25 continuously lets the ink flow toward the downstream side tank 2, the downstream side tank 2 does not let the ink flow because of the stoppage of the drive of pump 4, so that the liquid surface of the ink is raised. Since the rise of the liquid surface of the ink makes the air in the air chamber enter the bellows 30, makes the bellows 30 expand and, also the bellows 30 expands by the own weight of the spindle 31, the height of the spindle 31 begins to lower. At this moment, the operation determines whether or not the S5 sensor 29 has turned on (Step S173) then measures the spindle 31 in lowering for the count time t until the spindle 31 reaches the S5 sensor 29. If the turning on of the S5 sensor has been detected, the counting of the timer is terminated (Step S174). At this time, the rate of lowering of the spindle 31 depends on the amount of ink flowing into the downstream side tank 2 from the upstream side tank 3 through the recording head 25. The flow amount depends on the viscosity of the ink, namely the ink temperature.

The operation detects the ink temperature T by the temperature sensor 26, and compares the lowering time t(T) from the position of the S4 sensor 28 to the position of the S5 sensor 29 with the actually measured time t under the comparison condition of $[0.9\times t(T)<t<1.1\times t(T)]$ (Step S175). The appropriate lowering time t(T) for the ink temperature T is expressed in a table form, and is stored in the control unit (not shown) in a readable manner.

In this comparison, if the measured time t is within a range of ±10% of the appropriate lowering time t(T) calculated from the ink temperature T (YES, Step S175), it is determined that the ink circulation path (supply flow path 20, recording head 25, return flow path 21) has no abnormality, the operation shifts to Step S137. Conversely, if the time t deviates from the range (NO, Step S175), the operations determines that the ink circulation path has the abnormality, moves the ink pan below the recording head 25, opens the valves 9, 10, and moves the actuators 37, 38 to the home positions (step S176). After this operation, the operation reports the fact of the abnormality in the ink circulation path and of the error of the ink circulation.

The operation determines whether completion of the circulation has been issued (Step S137), and if the completion thereof has been issued (YES, Step S137), stops to drive the pump 4 (Step S138). The operation then opens the valves 9, 10 (Step S139), moves the spindle actuators 37, 38 to the home positions (Step S177), and terminates this flow operation. The actuator 37 moves to the home position HP while lifting the spindle 31, and the actuator 38 moves to the home position HP while lifting the spindle 34.

According to the embodiment, detecting the change in height of the lower part of the bellows 30 and the upper part of the bellows 33, while keeping the meniscus pressure of the nozzle 25*d* by the configuration in which the air chambers of both tanks 2, 3 sealed in order to generate the negative pressure and the positive pressure are connected to the bellows 30, 33 having variable volumes, respectively, through the air opening path enables detecting whether or not the ink in circulation flows normally.

While the embodiment has been described the method for detecting the abnormality in ink circulation depending on the change in height of the negative-pressure bellows 30, since the pressure bellows 33 changes in volume at the same time when the negative-pressure bellows 30 changes in volume, the abnormality may be detected depending on the change in height of the upper part of the bellows 33 in the similar method. When detecting the change in volume of the pressure bellows 33, since not only a case of ink circulation but also a case of ink leakage from the nozzle 2*d* because of the breaking of the meniscus of the nozzle 2*d* may be considered, these situations should be confirmed.

Modified examples of the first to fifth embodiments will be described hereinafter.

As regards the configuration of the aforementioned first to fifth embodiments, a method for predicting causes of the abnormality in ink circulation and performing those recoveries may be adopted. As mentioned above, the temperature sensors 26 are each disposed near by piezoelectric elements of a plurality of recording heads 25, or near by the ink circulation paths. The plurality of recoding heads 25 are connected to the head dive unit 18 through signal cables 27, and the recording heads 25 are drive-controlled through supplying drive power source, and through exchanges of control signals or sensor signals.

Each recording head 25 is driven with two kinds of wave forms of an ejection waveform ejecting ink droplets from the nozzle 25*d*, and a non-ejection waveform only vibrating an inner piezoelectric element 25*e* and not ejecting the ink. In a case in which the element 25*e* is driven by the ejection waveform or non-ejection waveform in a state in which the ink flows inside the recording head 25, the heat generated from the element 25*e* caused by the flow of the ink is cooled, and the increase in temperature of the element 25*e* itself hardly occurs. Meanwhile, in a state of stoppage of the ink circulation, since the heat generated from the element 25*e* itself does not diffused around the element 25*e*, the temperature of the element itself rapidly rises. In a case of clog of ink and a case of existence of babbles, the former case raises less increase in temperature. The temperature sensor 26 may detect the change in temperature.

Detecting the abnormality may be performed by using the characteristic of this change in temperature.

Figure 9:
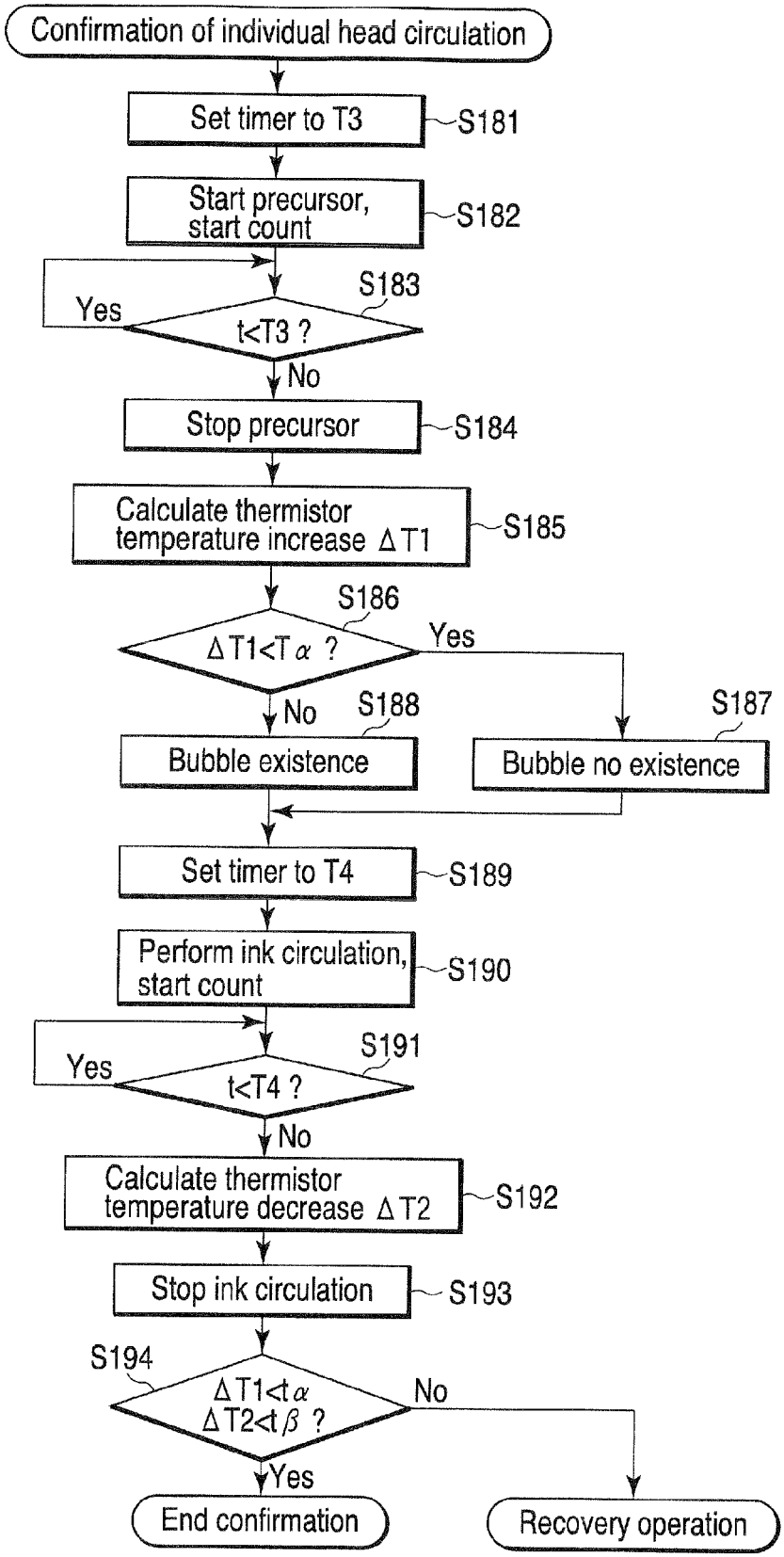
FIG. 9 is an exemplary flowchart for explaining a method for individually determining whether or not the flow of ink in circulation operation at recording heads in the first to fifth embodiments.
Figure 18:
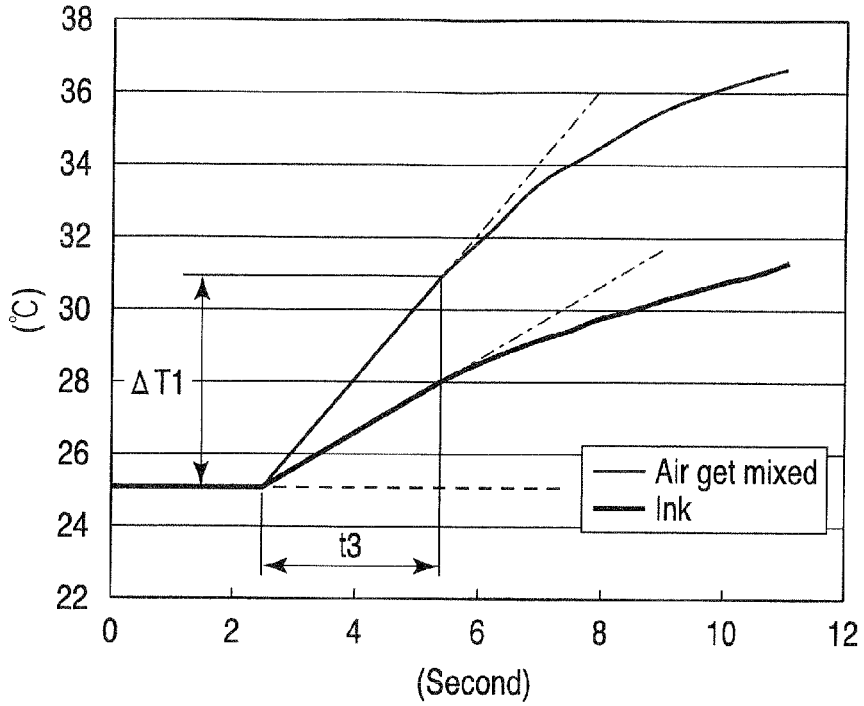
FIG. 18 is an exemplary view depicting a specific characteristic of a rise in temperature of a piezoelectric element to be driven in a state of stoppage of ink circulation in modified example of the first to fifth embodiments.
Figure 19:
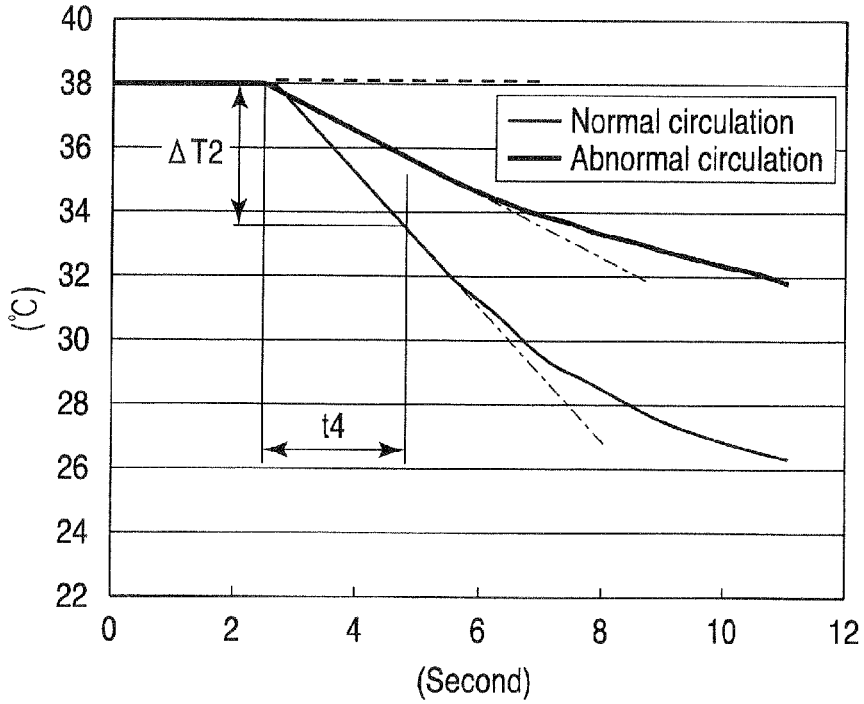
FIG. 19 is an exemplary view depicting a temperature characteristic of normal and abnormal ink circulation in modified examples of the first to fifth embodiments.

FIG. 18 shows a characteristic of a temperature increase in a piezoelectric element to be driven in a state of stoppage of ink circulation, and FIG. 19 shows a temperature characteristic in a case of abnormal ink circulation and in a case of stoppage of ink circulation. A method for determining whether or not flows of ink at individual recording heads in circulation operation are normal will be explained with reference to the flowchart shown in FIG. 9. In FIG. 9, an operation described as a "precursor" means a drive of the piezoelectric element 25*e* by the non-ejection waveform. While the temperature sensor 26 does not directly detect the temperature of the element 25*e*, detects the temperature nearby the attachment unit of the element 25*e* to and indirectly detects the temperature of the element 25*e*.

After setting a set time t3 to the timer (Step S181), in the foregoing image forming apparatus starts to drive (starts precursor) the element 25*e* in a state in which the ink is not circulated, and starts to count the timer (Step S182). The apparatus stands by until the count time t passes the set time t3 (YES, Step 183), continues to drive the element 25*e*, and if the time t passes the time t3 (NO, Step 183), stops to drive the element 25*e* (Step S184).

The apparatus then calculates a temperature change ΔT1 on the basis of the output from the temperature sensor 26 of each recording head 25 (Step S185). The apparatus compares the ΔT1 with a termination temperature tα (Step S186), if the temperature change ΔT1 is smaller than the termination temperature tα (YES, Step S186), determines that the ink has been filled (Step S187). If the temperature change ΔT1 is larger than the determination temperature tα (No, Step S186), the apparatus determines that the bubbles exist in the ink circulation path (Step S188).

The apparatus sets a set time t4 to the timer (Step S189), starts to circulate the ink, and starts to count the timer (Step S190). The apparatus determines whether or not the count time t exceeds the set time t4 (Step S191), after the time t exceeds the set Lime t4 (NO, Step 191), calculates a temperature change ΔT2 from a detection result of the temperature sensor 26 (Step S192). After the calculation, the apparatus stops to circulate the ink (Step S193).

The apparatus then compares the temperature change ΔT1 with the termination temperature tα, and compares the temperature change ΔT2 with a prescribed set temperature tβ (Step S194). If it is determined that the temperatures change ΔT2 is smaller than the set temperature tβ, it is determined that the amount of flowing ink is smaller than a scheduled amount. In accordance with combinations of the temperature changes ΔT1 and ΔT2, the following cases are determined.

(1) ΔT1<tα, ΔT2>tβ: Appropriate amount of ink is filled in the recording head 25 and the ink flows normally.

(2) ΔT1>tα, ΔT2>tβ: While air gets mixed in the recording head 25, appropriate amount of ink flows normally.

(3) ΔT1>tα, ΔT2<tβ: Air get mixed in the recording head 25, ink does not flow normally (4) ΔT1<tα, ΔT2<tβ: While air does not get mixed in the recording head 25, ink does not flow normally (e.g., clog of ink).

In such cases, if in a case of "ΔT1<tα, and not ΔT2>tβ", the apparatus performs a recovery operation.

As mentioned above, detecting the ink circulation situations in the recording heads 25 by detection the temperature changes of the piezoelectric elements 25*e* by using the temperature sensors 26 individually provided for the plurality of recoding heads 25 enables determining the situations of the individual recording heads 25 which cannot determine from the entire flow amount of ink. As regards the first to fifth embodiments, determining with appropriate combination of circulation abnormality detection in the entire flow amount of ink of the downstream side tank 2 or the upstream side tank 3 and of circulation abnormality detection to be determined from the detection result of the temperature sensor 26*s* provided for individual recording heads 25 enables obtaining an accurate detection result.

According to each embodiment of the invention described above, the following effects may be produced.

1. Before starting an ink circulation by a pump, opening air in both upstream side and downstream side tanks, flowing ink from the upstream side tank to the downstream side tank only with a head pressure difference, and detecting whether a prescribed amount of ink is stored in the downstream side tank within a prescribed time enables confirming whether or not an ink circulation path is in a normal state capable of letting the ink flow normally through recording head.

2. In ink circulation (in image formation), detecting a duty of a pump adjusted so that a pressure in an air chamber of the downstream side tank becomes a prescribed pressure and an ink temperature, and comparing the adjusted duty of the pump with an appropriate duty matched to the ink temperature, enables confirming whether or not an ink has been normally flowing through the recording head. In this case, only by detecting the duty of the pump, it is determined whether a circulation flow amount varying in response to the ink temperature, as a result, enables confirming whether or not the ink circulation path is in the normal state. Since the image forming apparatus may detect the state of the ink circulation path without varying a height of a liquid surface of the downstream side tank, and without breaking a meniscus to be formed at a nozzle of the recording head, the apparatus can detect the state of the ink circulation path even in image formation.

3. Arranging a negative bellows as an elastic body varying its volume in a negative pressure air layer of the downstream flow tank disposed on a flow path for circulating the ink therein, providing a spindle matching to a desired negative pressure for the negative bellows, varying a position (contraction state) of the negative bellows by varying supplying amounts of the pump, enables detecting whether or not the ink circulation path is in a state in which the ink normally flows through the recording head without varying a meniscus pressure to be formed at the nozzle of the recording head by detecting the variations.

4. Making temperature sensors individually provided for a plurality of recording heads generate heat through a piezoelectric element, and discharging the heat from circulating ink at an increase in temperature and after the increase enables determining whether the ink has been appropriately filled in the recording heads or whether the ink has flowed normally based in the decrease in temperature caused by cooling, and also enables determining the fact depending on an aspect of ink flowing to each recording head which cannot be determined from the entire amount of ink flowing to all the recording heads.

As described above, the present invention may provide the method for confirming ink circulation path and the method for filling with ink configured to detect a flow of ink even in image formation, and prevent intake of bubbles and leakage of ink while maintaining a pressure for ejecting the ink in an appropriate range.

What is claimed is:

1. A method for confirming an ink circulation path, the ink circulation path including: at least one recording head which ejects ink to form an image; an upstream side tank with the ink filled therein; a downstream side tank with the ink filled therein; a first ink path which connects between the upstream side tank and the recording head; a second ink path which connects between the recording head and the downstream side tank; a third ink path which connects between the downstream side tank and the upstream side tank; and a sensor which detects a displacement amount of a parameter varying in response to an amount of ink in the downstream side tank, the ink circulating again to the upstream side tank in order of the upstream side tank, the first ink path, the recording head, the second ink path, the downstream side tank, and the third ink path, the method comprising:

a first ink supply process of supplying ink in the upstream side tank toward the downstream side tank through the first and the second ink paths;

a second ink supply process of supplying ink in the downstream side tank toward the upstream side tank through the third ink path with a supply amount which is larger than a supply amount of ink in the first ink supply process;

an ink supply stop process of stopping the second ink supply process when the displacement amount of the parameter is detected, and when it is detected that the parameter changes from a first value to a second value which is smaller than the first value by detecting the displacement amount of the parameter while performing the first ink supply process and second ink supply process;

a time measurement process of measuring a time until the parameter returns to the first value from execution of the ink supply stop process; and a comparison process of comparing whether or not a measured time in the time measurement process is not longer than a prescribed set time.

2. The method according to claim 1, wherein:

the parameter is a height of a liquid surface of ink in the downstream side tank;

the sensor is a liquid surface detection sensor which detects the height of the liquid surface of the ink in the downstream side tank;

the ink supply stop process stops the second ink supply process when the liquid surface of the ink in the downstream side tank becomes a second height which is lower than a first height; and the time measurement process measures a time until the liquid surface of the ink in the downstream side tank reaches the first height from the second height after execution of the ink supply stop process.

3. The method according to claim 1, wherein:

the parameter is a height of a liquid surface of ink in the downstream side tank;

the sensor is a liquid surface detection sensor which detects that the height of the liquid surface of the ink in the downstream side tank becomes a prescribed height, and outputs power-on of the sensor;

the ink supply stop process stops the second ink supply process when the output from the liquid surface detection sensor becomes power-on to power-off of the liquid surface detection sensor; and the time measurement process measures a time until the liquid surface detection sensor is powered on again after execution of the ink supply stop process.

4. The method according to claim 1, wherein:

a bellows is provided which is connected in an airtight manner to the downstream side tank, expands and contracts in response to an amount of ink in the downstream side tank, and of which the tip is displaced;

the parameter is a position of the tip of the bellows;

the sensor is a position sensor which detects a position of the tip of the bellows;

the ink supply stop process stops the second ink supply process when the position sensor detects that the tip of the bellows reaches a first position by contraction of the bellows; and the time measurement process measures a time until the tip reaches a second position which is lower than the first position by expansion of the tip of the bellows after execution of the ink supply stop process.

5. The method according to claim 1, further comprising:

a confirmation process of confirming the ink circulation path by repeating more than one time a step comprising the first and the second ink supply processes, the ink supply stop process, the time measurement process, and the comparison process.

6. The method according to claim 1, further comprising:

an ink filling process of filling the ink to the first and the second ink paths when the measured time passes the prescribed set time in the comparison process.

7. The method according to claim 1, further comprising:

an ink circulation process of circulating the ink in the first to the third ink paths when the measured time passes the prescribed set time in the comparison process.

8. The method according to claim 7, wherein:

the method further includes:

detecting a pressure in the downstream side tank with a pressure sensor, and the ink circulation process comprises a third ink supply process of supplying the ink in the downstream side tank toward the upstream side tank through the third ink path so as to make the pressure in the downstream side tank constant on the basis of a detection result from the pressure sensor.

9. The method according to claim 8, wherein the method further includes: detecting a temperature of the ink with a temperature sensor, and the third ink supply process comprises:

an appropriate ink supply amount calculation process of calculating a supply amount of ink from the downstream side tank to the upstream side tank based on the temperature of the ink detected by the temperature sensor; and a determination process of determining whether or not an actual ink supply amount to be actually supplied from the downstream side tank to the upstream side tank coincides with an ink supply amount calculated in the appropriate ink supply amount calculation process.

10. The method according to claim 9, wherein the method further includes:

supplying ink from the downstream side tank to the upstream side tank with a pump; and the third ink supply process calculates the ink supply amount from duty to be loaded on the pump.

11. The method according to claim 9, further comprising:

a refilling process of refilling ink from a bottle toward the upstream side tank or the downside stream tank, wherein the determination process is executed other than a time in which the refilling process is executed.

12. The method according to claim 9, wherein the determination process is executed at a time other than a time in which an image formation process by the recording head is executed.

13. The method according to claim 7, wherein a bellows is provided which is connected in an airtight manner to the downstream side tank, expands and contracts in response to an amount of ink in the downstream side tank, and of which the tip is displaced;

the method further includes detecting a position of the tip of the bellows with a position sensor, and the ink circulation process comprises:

a third ink supply process of supplying the ink in the downstream side tank toward the upstream side tank through the third ink path so as to make the tip of the bellows stays within a prescribed range on the basis of a detection result from the position sensor.

14. The method according to claim 13, wherein the method further includes detecting a temperature of the ink with a temperature sensor, and the third ink supply process comprises:

an appropriate time calculation process of calculating a time required to displacement of a prescribed amount of the bellows on the basis of the temperature of the ink detected by the temperature sensor; an actual time measurement process of measuring an actual time actually required to displacement of a prescribed amount of the bellows; and a determination process of determining whether or not an actual time measured in the actual time measurement process coincides with a time calculated in the appropriate time calculation process.

15. A method for confirming an ink circulation path, the ink circulation path including: at least one recording head which ejects ink to form an image; an upstream side tank with the ink filled therein; a downstream side tank with the ink filled therein; a first ink path which connects between the upstream side tank and the recording head; a second ink path which connects between the recording head and the downstream side tank; a third ink path which connects between the downstream side tank and the upstream side tank; and a sensor which detects a displacement amount of a parameter varying in response to an amount of ink in the upstream side tank, the ink circulating again to the upstream side tank in order of the upstream side tank, the first ink path, the recording head, the second ink path, the downstream side tank, and the third ink path, the method comprising:

a first ink supply process of supplying ink in the upstream side tank toward the downstream side tank through the first and the second ink paths;

a second ink supply process of supplying ink in the downstream side tank toward the upstream side tank through the third ink path with a supply amount larger than a supply amount of ink in the first ink supply process;

an ink supply stop process of stopping the second ink supply process when the displacement amount of the parameter is detected, and when it is detected that the parameter becomes a first value from a prescribed second value to a first value which is larger than the second value;

a time measurement process of measuring a time until the parameter returns to the second value from execution of the ink supply stop process; and a comparison process of comparing whether or not a measured time in the time measurement process is not longer than a prescribed set time.

16. The method according to claim 15, wherein:

the parameter is a height of a liquid surface of ink in the downstream side tank;

the sensor is a liquid surface detection sensor which detects the height of the liquid surface of the ink in the downstream side tank;

the ink supply stop process stops the second ink supply process when the liquid surface of the ink in the upstream side tank reaches a second height which is higher than a first height; and the time measurement process measures a time until the liquid surface of the ink in the upstream side tank reaches the first height from the second height after execution of the ink supply stop process.

17. The method according to claim 15, wherein:

a bellows is provided which is connected in an airtight manner to the upstream side tank, expands and contracts in response to an amount of ink in the upstream side tank, and of which the tip is displaced;

the parameter is a position of the tip of the bellows;

the sensor is a position sensor which detects the position of the tip of the bellows;

the ink supply stop process stops the second ink supply process when the bellows expands and it is detected that the tip of the bellows reaches a first position; and the time measurement process measures a time until the tip of the bellows reaches a second position which is lower than the first position by contracting the tip of the bellows after execution of the ink supply stop process.

* * * * *